US006889030B2

(12) United States Patent
Koide et al.

(10) Patent No.: US 6,889,030 B2
(45) Date of Patent: May 3, 2005

(54) IMAGE FORMING APPARATUS WITH AN INTERMEDIATE IMAGE TRANSFER BODY AND PROVISIONS FOR CORRECTING IMAGE TRANSFER DISTORTIONS

(75) Inventors: Hiroshi Koide, Kanagawa (JP); Sadayuki Iwai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 10/387,506

(22) Filed: Mar. 14, 2003

(65) Prior Publication Data

US 2003/0210932 A1 Nov. 13, 2003

(30) Foreign Application Priority Data

Mar. 14, 2002 (JP) ..... 2002-069816
Mar. 14, 2002 (JP) ..... 2002-069821
Mar. 14, 2002 (JP) ..... 2002-069825

(51) Int. Cl.[7] ..... G03G 15/01; G03G 15/08
(52) U.S. Cl. ..... 399/302; 399/308
(58) Field of Search ..... 399/298, 299, 399/302, 308

(56) References Cited

U.S. PATENT DOCUMENTS 4,531,828 A 7/1985 Hoshino
5,150,161 A * 9/1992 Bujese ..... 399/308
5,508,789 A 4/1996 Castelli et al.
5,708,938 A 1/1998 Takeuchi et al.
5,737,678 A * 4/1998 Volkers et al. ..... 399/302
5,809,388 A 9/1998 Inada et al.
5,864,737 A 1/1999 Obu et al.
5,923,930 A 7/1999 Tsukamoto et al.
5,987,281 A 11/1999 Kurotori et al.
5,987,282 A 11/1999 Tsukamoto et al.
6,070,041 A 5/2000 Nakayasu et al.

(Continued)

FOREIGN PATENT DOCUMENTS

JP 62-264067 11/1987
JP 5-289455 11/1993
JP 6-149084 5/1994
JP 7-31446 4/1995
JP 9-43932 2/1997
JP 9-244422 9/1997
JP 10-20579 1/1998
JP 2001-34025 2/2001
JP 2001-100488 4/2001
JP 2001-100614 4/2001
JP 2001-265079 9/2001
JP 2001-265081 9/2001
JP 2001-318507 11/2001
JP 2001-343808 12/2001
JP 2002-174942 6/2002

OTHER PUBLICATIONS

U.S. Appl. No. 10/739,279, filed Dec. 19, 2003, Iwai.
U.S. Appl. No. 10/634,783, filed Aug. 6, 2003, Matsuda et al.

*Primary Examiner*—Susan Lee
(74) *Attorney, Agent, or Firm*—Oblon, Spivak, McClelland, Maier & Neustadt, P.C.

(57) ABSTRACT

An image forming apparatus of the present invention includes at least one rotatable image carrier, an image forming device for forming different images on the image carriers, a first image transferring device for transferring the images from the image carriers to a first image transfer body driven to move via a first image transfer position where it faces the image carriers, and a second image transferring device for transferring the resulting composite image from the first image transfer body to a second image transfer body driven to move via a second image transfer position where it faces the first image transfer body. The moving speed of each image carrier is equal to the moving speed of the second image transfer body. A period of time necessary for the surface of the first image transfer body to move from the first image transfer position to the second image transfer position is a natural number multiple of the period of speed variation occurring on the above surface.

42 Claims, 16 Drawing Sheets

U.S. PATENT DOCUMENTS 6,088,565 A * 7/2000 Jia et al. ..... 399/302
6,115,576 A 9/2000 Nakano
6,343,053 B1 1/2002 Akanuma et al.
6,347,212 B1 2/2002 Kosugi et al.
6,445,656 B1 9/2002 Koide
6,448,997 B1 9/2002 Koide
6,487,149 B1 11/2002 Yokoi et al.
6,507,713 B2 1/2003 Koide
6,545,958 B1 4/2003 Hirai et al.
6,604,461 B1 * 8/2003 De Bock et al. ..... 399/302
6,701,109 B2 * 3/2004 Yoda et al.
6,724,161 B2 * 4/2004 Ueda et al.
2002/0003755 A1 1/2002 Koide et al.
2002/0003973 A1 1/2002 Saito
2002/0067934 A1 * 6/2002 Jia et al. ..... 399/302
2002/0149329 A1 * 10/2002 Ueda et al.
2003/0021615 A1 * 1/2003 Asano et al. ..... 399/299

* cited by examiner

IMAGE FORMING APPARATUS WITH AN INTERMEDIATE IMAGE TRANSFER BODY AND PROVISIONS FOR CORRECTING IMAGE TRANSFER DISTORTIONS

BACKGROUND OF THE INVENTION

1. Field of the Invention

The present invention relates to a copier, printer facsimile apparatus or similar image forming apparatus. More particularly, the present invention relates to an image forming apparatus of the type transferring toner images sequentially formed on photoconductive drums or similar image carriers to an intermediate image transfer belt or similar first image transfer body one above the other and then transferring the resulting composite toner image to a recording medium or similar second image transfer body.

2. Description of the Background Art

To meet the increasing demand for color copies, an electrophotographic image forming apparatus is spreading for medium- and high-speed applications while an ink jet type image forming apparatus is predominant for low-speed applications. Particularly, a tandem color image forming apparatus is feasible for high-speed applications and includes a plurality of photoconductive drums or image carriers arranged side by side in the direction of sheet conveyance. Also feasible for high-speed applications is an image forming apparatus configured such that a toner image is transferred to a sheet or second transfer body by way of an intermediate image transfer belt or first transfer body.

Japanese patent Laid-Open Publication No. 10-246995, for example, discloses a tandem color image forming apparatus including four photoconductive drums arranged side by side in a direction in which a belt conveys a sheet. A light beam issuing from a particular optical writing unit scans each drum in the axial direction of the drum, i.e., the main scanning direction, forming a latent image on the drum. Developing units each being assigned to a particular drum develop such latent images with toners of different colors, i.e., cyan, magenta, yellow and black, thereby producing corresponding toner images. The toner images are sequentially transferred from the drums to a sheet being conveyed by the belt one above the other by chargers. After the resulting composite toner image has been fixed on the sheet, the sheet or print is driven out of the apparatus to a print tray. In this manner, a four-color or full-color image can be formed on a sheet only if the sheet is conveyed via the consecutive image transfer positions one time.

In another tandem color image forming apparatus, an intermediate image transfer belt is substituted for the belt stated above. In this type of apparatus, the toner images of four different colors are superposed on each other on the intermediate image transfer belt and then transferred to a sheet.

Problems to which the present invention addresses will be described hereinafter.

[Problem 1]

In the tandem color image forming apparatus of the type using the intermediate image transfer belt (simply belt hereinafter), toner images of different colors are sequentially transferred from the drums to the belt one above the other, forming a color image. Therefore, if the toner images are shifted from each other on the belt, then the colors of the color image are shifted from each other. Some different measures against such color shifts are taught in, e.g., Japanese Patent No. 2,929,671 and Japanese Patent Laid-Open Publication Nos. 63-11967 and 59-182139. Also, color shifts to occur when the drums and belt or sheet are moved at different speeds are discussed in, e.g., Kido and Iijima "Studies on Slip Transfer Mechanism", Fuji Xerox Technical Report, No. 13 (Technical Report hereinafter).

In the tandem color image forming apparatus, even if the drums differ in eccentricity and radius from each other, the color images on the belt are free from color shifts only if the drums rotate at the same angular velocity and if the speed of the belt is constant. However, if gears included in a driveline assigned to the drums or the belt have eccentricity, then the angular velocities of the drums or the moving speed of the belt varies even though a motor or drive source may rotate at a constant speed, resulting in color shifts, as discussed in Technical Report and various publications.

In light of the above, Japanese Patent No. 2,929,671 mentioned earlier proposes to make an integral multiple of the period of variation ascribable to, e.g., the gears equal to a period of time necessary for each drum to rotate from an exposure position to an image transfer position. Also, Laid-Open Publication No. 63-11967 proposes to make an integral multiple of the period of variation of the drum driveline equal to a period of time necessary for the belt or the sheet to move between nearby drums. Further, Laid-Open Publication No. 59-182139 proposes to make an integral multiple of the period of rotation of a belt drive roller equal to a period of time necessary for the belt or the sheet to move between nearby drums.

We, however, found that none of the above conventional measures could obviate the expansion or the contraction of a pixel in the image transferred from the belt to the sheet and ascribable to the periodic speed variation of the belt. This is presumably because when the speed of the belt periodically varies, the belt speed varies between the primary transfer of a given pixel from the drum to the belt and the secondary transfer of the same pixel from the belt to the sheet, causing the pixel to expand or contract. Technical Report or the other publications do not address to the expansion and contraction of pixels ascribable to the periodic speed variation of the belt.

[Problem 2]

When a speed difference or relative speed between the drum and the belt, sheet or similar first image transfer body, as measured at the first image transfer position, increases, a pixel expands or contracts at the first image transfer position and lowers image quality, as will be described hereinafter.

Assume that a speed difference or slip occurs between the drum and the belt at the first image transfer position where they contact each other. Then, the line width of an image varies, i.e., expands or contracts by an amount δI:

$$\delta I=(W_1+Iw)\cdot\Delta V/Vd \qquad \text{Eq. (1)}$$

where ΔV denotes a difference between the peripheral speed Vd of the drum and the peripheral speed Vb of the belt (Vd−Vb), and $W_1$ denotes the width of a nip between the drum and the belt at the first image transfer position. The amount δI refers to a difference between the width Iw of a line image formed on the drum and the width of the corresponding line image formed on the belt.

The Eq. (1) indicates that as the speed difference ΔV (=Vd−Vb) increases, the amount of variation δI of the line width transferred from the drum to the belt increases. Further, the Eq. (1) indicates that the toner image formed on the drum is transferred to the belt while being rubbed, and that the amount δI varies due to the variation of the nip width $W_1$. The nip width $W_1$ varies in accordance with drum radius as well and generally increases with an increase in drum radius.

Assume that the angular velocity of the drum has a constant value of ωo, that the drum has a radius of Ro, and that the length of an exposed pixel for a unit time is Ie=Roωo. Then, when the drum has a radius of Ro+ΔRo, the length I of the exposed pixel is increased by Roωo for a unit time, as produced by:

$$I=(Ro+\Delta Ro)\omega o=Ie+\Delta Ro\omega o \quad \text{Eq. (2)}$$

Assuming that the belt speed Vb is Roωo, then a speed difference ΔV=ΔRoωo occurs between the drum surface and the belt at the first image transfer position. As a result, the pixel is contracted by the length δI derived from the Eq. (1), as produced by:

$$\delta I = (W_1 + I)\cdot \Delta V / Vd \quad \text{Eq. (3)}$$

$$= (W_1 + Ie + \Delta Ro\omega o)\cdot \Delta Ro / (Ro + \Delta Ro)$$

It follows that the expansion ΔRoωo of the pixel for a unit time at the time of exposure is contracted by the amount produced by the Eq. (3). Particularly, when the nip width $W_1$ at the first image transfer position is zero, the pixel is contracted by ΔRoωo. More specifically, the discussion that when the angular velocity of the drum is constant, the pixel length remains the same even if the drum radius is irregular holds only when the nip width $W_1$ is zero. This is also true when the drum has eccentricity.

If the influence of the nip width $W_1$ is not negligible in the Eq. (3), then an error or contraction of $$Ce=W_1\cdot \Delta Ro/(Ro+\Delta Ro)$$

occurs in the pixel length. More specifically, the pixel is expanded or contracted due to the nip width $W_1$, as expressed as:

$$\delta I = (W_1 + Ie + \Delta Ro\omega o)\Delta Ro / (Ro + \Delta Ro) \quad \text{Eq. (4)}$$

$$= W_1 \cdot \Delta Ro / (Ro + \Delta Ro) + \Delta Ro\omega o$$

When the speed variation between the drum and the belt or similar first image transfer body at the first image transfer position is reduced, the following advantage is achievable. For example, assume that the belt speed Vb is Roωo, and that the drum angular velocity is varied such that the moving speed at the first image transfer position becomes zero when the drum radius reaches Ro+ΔRo. Then, the drum angular velocity ω is derived from (Ro+ΔRo)ω=Vb=Roωo, as follows:

$$\omega=\{Ro/(Ro+\Delta Ro)\}\omega o \quad \text{Eq. (5)}$$

Therefore, the exposed pixel length Ie for a unit period of time is (Ro+ΔRo)ω=Roωo, meaning that the length Ie does not increase. Because the speed difference ΔV is zero at the image transfer position, there holds $\delta I=(W_1+Iw)\cdot \Delta V/Vd=0$. In this case, an image free from expansion and contraction ascribable to the influence of the nip width $W_1$ is achieved. More specifically, the smaller the speed difference ΔV at the first image transfer position, the less the influence of the nip width $W_1$ on the image.

However, even if the speed difference ΔV is reduced at the design stage, any eccentricity of the drum or any variation of the belt speed ascribable to the eccentricity of the belt drive roller is likely to cause the speed difference ΔV to periodically increase. Should the speed variation ΔV increase, the pixels would be expanded or contracted at the first image transfer position due to the influence of the nip width $W_1$. None of Technical Report and other publications even mentions the expansion or the contraction of pixels at the first image transfer position ascribable to the above cause.

Technical Report describes the following in relation to the degradation of image quality to occur in the image transferring step, i.e., degradation to occur at the nip for image transfer. According to Technical Report, a line width of 42.3 μm starts increasing little by little when the moving speed of the surface of an intermediate image transfer body (roller) exceeds about +0.5% of the moving speed of the surface of a drum (see Photo 1 and FIG. 9 of Technical Report). A specific procedure for calculating influence of the eccentricity of the drum and the irregularity of drum radius on the above surface moving speed will be described hereinafter. Assume that the drum radius is 30 mm and that irregularity in radius is ±30 μm, and that eccentricity is ±30 μm. The drum surface speed (peripheral speed) at the first image transfer position is assumed to be about ±0.3% when the drum is rotating at a constant angular velocity in terms of probability tolerance. It follows that if the description of Technical Report is true, then it is likely that the line width periodically increases in synchronism with the variation of the drum speed. Further, it is likely that the variation of the speed difference at the first image transfer position increases due to other factors: including the speed variation of the belt, which is the intermediate image transfer belt or the simple conveying belt.

The degradation of image quality ascribable to the speed difference between the drum and the belt at the first image transfer position obstructs further enhancement of image quality. Although fabrication technologies may be improved to reduce irregularity in drum radius or to increase eccentricity accuracy, such a scheme is undesirable from the cost reduction standpoint. While the drums, which are expensive, are replaced when they wear, this, of course, increases user's load.

[Problem 3]

To obviate so-called hollow characters or hollow pixels, Japanese Patent Laid-Open Publication Nos. 10-39648 and 62-35137, for example, propose to establish a certain speed difference between the drum and the belt or the sheet at the image transfer position. Assume that a speed difference or relative speed ΔVh (=Vd−Vb) is established at the first image transfer position; Vd and Vb respectively denote the moving speed of the belt or the sheet and the peripheral speed of the drum free from irregularity in radius. Further, assume that the angular velocity of the drum has a constant value of ωo while the drum radius is Ro, and that the length Ie of an exposed pixel for a unit period of time is Roωo. Then, the length I of the exposed image when the drum radius is Ro+ΔRo is expanded by ΔRoωo for the unit period of time, as expressed as:

$$I=(Ro+\Delta Ro)\omega o=Ie+\Delta Ro\omega o \quad \text{Eq. (6)}$$

The belt speed Vb is therefore Roωo−ΔVh, so that the speed difference ΔV of Roωo+ΔVh occurs at the first image transfer position. It follows that the pixel length varies by δI on the basis of the Eq. (3), as follows:

$$\delta I = (W_1 + I)\cdot \Delta V / Vd \quad \text{Eq. (7)}$$

$$= \{W_1 + Ie + \Delta Ro\omega o\}(\Delta Ro\omega o + \Delta Vh) / \{\omega o(Ro + \Delta Ro)\}$$

Therefore, while the pixel is expanded by ΔRoωo for the unit period of time at the exposure stage, the pixel length is varied at the image transfer stage by δI:

$$\delta I = \{W_1 + (Ro + \Delta Ro)\omega o\}(\Delta Ro\omega o + \Delta Vh)/\{\omega o(Ro + \Delta Ro)\} \quad \text{Eq. (8)}$$

$$= W_1 \cdot (\Delta Ro\omega o + \Delta Vh)/\{\omega o(Ro + \Delta Ro)\} + (\Delta Ro\omega o + \Delta Vh)$$

When the nip width $W_1$ for image transfer is zero, the pixel is contracted by $\Delta Ro\omega o+\Delta Vh$. More specifically, the discussion that even when the drum radius is irregular, it does not vary pixels if the angular velocity of the drum is constant holds only if the nip width $W_1$ at the first image transfer position is zero and if the speed difference $\Delta Vh$ is zero. However, when the speed difference $\Delta Vh$ is constant, the entire image is expanded (magnification error). This is also true when the drum has eccentricity.

It will now be seen that an error or contraction Ce occurs in the image due to the influence of the nip width $W_1$ and sped difference $\Delta Vh$ at the first image transfer position:

$$Ce=W_1\cdot(\Delta Ro\omega o+\Delta Vh)/\{\omega o(Ro+\Delta Ro)\}+\Delta Vh \quad \text{Eq. (9)}$$

Further, when the speed variation $\delta V$ of the belt is added, i.e., when the speed difference $\Delta Vh$ and the speed variation $\delta V$ of the belt are established to obviate hollow characters, the following error E occurs:

$$E=W_1\cdot\{\Delta Ro\omega o+(\Delta Vh+\delta V)\}/\{\omega o(Ro+\Delta Ro)\}+(\Delta Vh+\delta V) \quad \text{Eq. (10)}$$

Japanese Patent Laid-Open Publication No. 2001-265081, for example, discloses an image forming apparatus configured to reduce the expansion or the contraction of a toner image despite the speed difference provided at the image transfer position for obviating hollow characters. This image forming apparatus uses a slip transfer type of image transfer system in which a speed difference is established between two surfaces facing each other at a first and a second image transfer positions. The speed differences at the two positions are opposite in sign to each other for thereby canceling the expansion or the contraction of a pixel, as will be described more specifically later.

Japanese Patent Laid-Open Publication No. 2000-338745 also shows a construction in which the peripheral speed of a drum and the moving speed of a sheet are equal, but the speed of an intermediate image transfer body is different. More specifically, a speed difference is established between the drum and the intermediate image transfer body so as to restore the original length of pixels at the second image transfer position.

We, however, found a case wherein the expansion or the contraction of a pixel could not be surely canceled due to factors not addressed to in the above two Laid-Open Publications.

[Problem 4]

We found an electrophotographic process in which the Eq. (1) held when the peripheral speed of the drum and that of the intermediate image transfer body differed from each other. More specifically, although the direction of the influence of the nip width $W_1$ on the expansion or the contraction of a toner image was dependent on the sign of the speed difference $\Delta V$, there was found an electrophotographic process in which pixels were thickened or expanded without regard to the speed difference $\Delta V$, resulting in the deterioration of image quality. This will be described more specifically later.

Technologies relating to the present invention are also disclosed in, e.g., Japanese Patent Laid-Open Publication Nos. 5-289455, 6-149084, 9-43932, 9-244422, 10-20579, 2001-34025, 2001-100614, 2001-265079, 2001-265081, 2001-318507, 2001-337561, 2001-343808 and 2002-174942 as well as in Japanese Patent Publication Nos. 7-31446 and 7-76850.

SUMMARY OF THE INVENTION

It is an object of the present invention to provide an image forming apparatus capable of reducing, even when the moving speed of an image transfer body intervening between an image carrier and a recording medium periodically varies, the expansion or the contraction of a pixel ascribable to the variation to thereby insure high image quality.

It is another object of the present invention to provide an image forming apparatus capable of reducing, even when an image carrier has eccentricity or irregularity in radius, the expansion or the contraction of a pixel at a first image transfer position and reducing a positional shift between pixels.

It is still another object of the present invention to provide an image forming apparatus capable of surely canceling the expansion or the contraction of a pixel while obviating hollow characters, thereby insuring high image quality.

It is a further object of the present invention to provide an image forming apparatus capable of correcting, when use is made of an image transfer process of the type causing the edge of a pixel to expand, the expansion of the pixel without regard to the sign of a speed difference or relative speed at an image transfer position.

An image forming apparatus of the present invention includes at least one rotatable image carrier, an image forming device for forming different images on the image carriers, a first image transferring device for transferring the images from the image carriers to a first image transfer body driven to move via a first image transfer position where it faces the image carriers, and a second image transferring device for transferring the resulting composite image from the first image transfer body to a second image transfer body driven to move via a second image transfer position where it faces the first image transfer body. The moving speed of each image carrier is equal to the moving speed of the second image transfer body. A period of time necessary for the surface of the first image transfer body to move from the first image transfer position to the second image transfer position is a natural number multiple of the period of speed variation occurring on the above surface.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
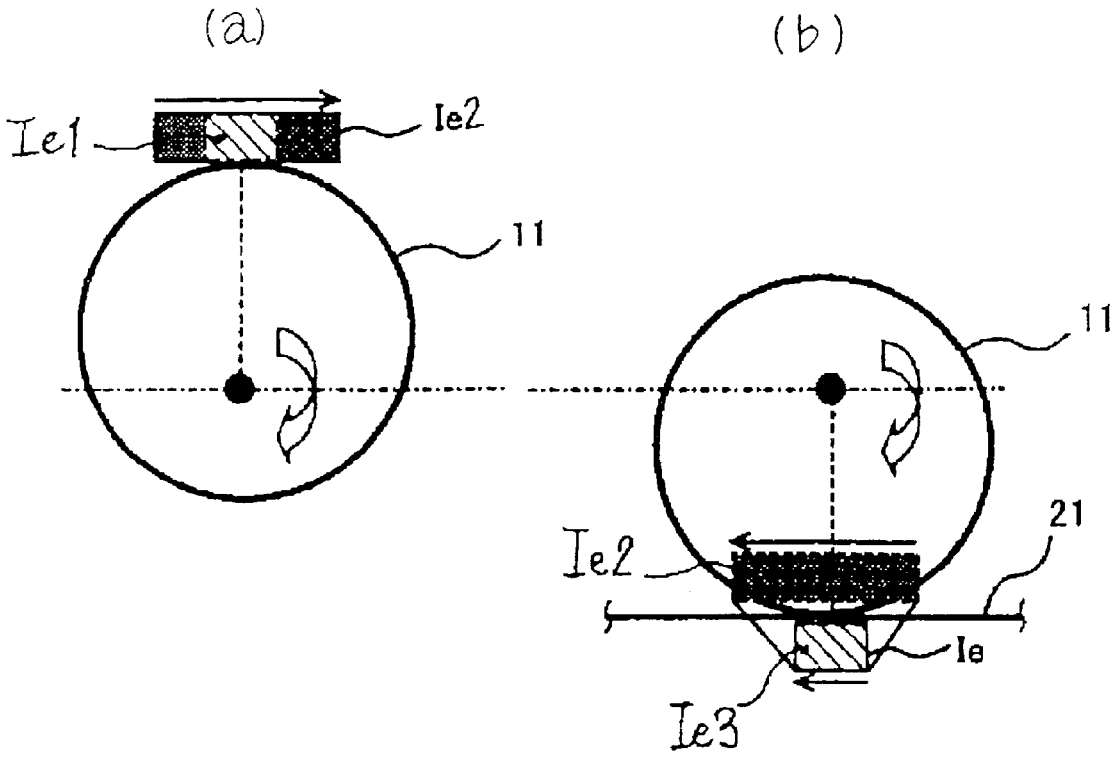
FIG 1 PRIOR ART
FIGS. 1A and 1B are views for describing how a color shift is coped with by a conventional tandem color image forming apparatus.
Figure 2:
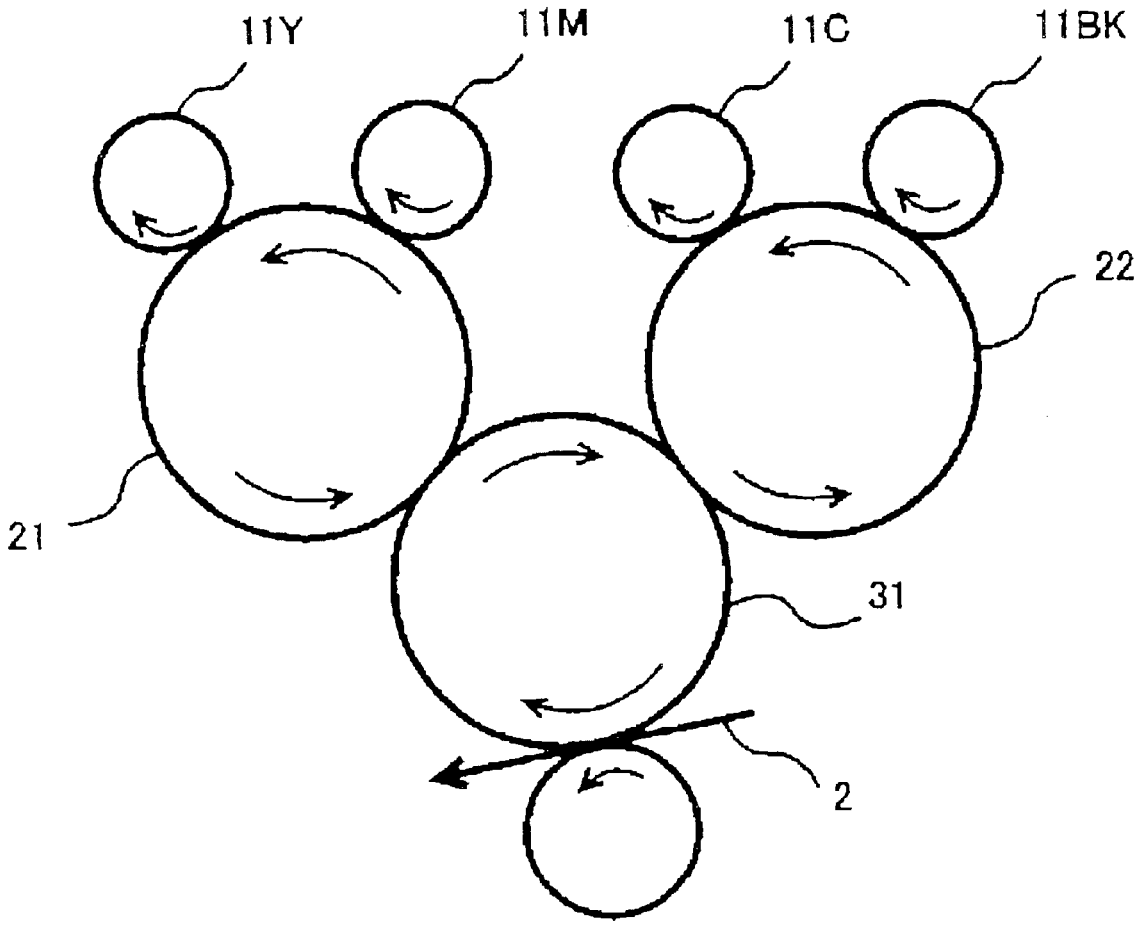
FIG. 2 PRIOR ART
FIGS. 2 and 3 are views showing a conventional tandem color image forming apparatus of the type using intermediate image transfer drums.

To better understand the present invention, reference will be made to conventional technologies. A tandem color image forming apparatus of the type using an intermediate image transfer belt or first image transfer body has the problem [1] stated earlier. More specifically, as shown in FIG. 1, even if photoconductive drums 11 have eccentricity and differ in radius from each other, color images on the intermediate image transfer belt are free from color shifts only if the drums 11 rotate at the same angular velocity and if the speed of the belt is constant. That is, even when a pixel Ie is expanded at an exposure position due to the eccentricity of the drum 11 (Ie1→Ie2), as shown in FIG. 1, (a), the pixel Ie is contracted at a first image transfer position (Ie2→Ie3), as shown in FIG. 2(*b*), so that the pixel has a preselected length on an intermediate image transfer belt 21. However, if gears included in a driveline assigned to the drums or the belt have eccentricity, then the angular velocities of the drums or the moving speed of the belt varies even though a motor or drive source may rotate at a constant speed, resulting in color shifts.

Measures against such color shifts are taught in Laid-Open Publication Nos. 63-11967 and 59-182139, U.S. Pat. No. 2,929,671 and other documents mentioned earlier. However, even such measures cannot obviate the expansion or the contraction of a pixel in the image transferred from the belt to the sheet and ascribable to the periodic speed variation of the belt. This is presumably because when the speed of the belt periodically varies, the belt speed varies between the primary transfer of a pixel from the drum to the belt and the secondary transfer of the same pixels from the belt to the sheet, causing the pixel to expand or contract, as state earlier.

On the other hand, hollow characters, i.e., thin lines with hollow centers are apt to occur in the conventional color image forming apparatus, as stated in [Problem 3]. To obviate hollow characters, Laid-Open Publication Nos. 10-39648 and 62-35137 mentioned earlier propose to establish a certain speed difference between the drum and the belt or the sheet at the image transfer position. More specifically, as shown in FIG. 2, a speed difference $V_1$ between photoconductive drums 111Y, 11M, 11C and 11BK and two intermediate image transfer drums or first image transfer bodies 21 and 22 and a speed difference $V_2$ between the intermediate image transfer drums 21 and 22 and an intermediate image transfer drum 31 are made different in sign from each other for thereby reducing expansion and contraction. Particularly, according to the above documents, expansion and contraction can be canceled if the speeds of the above components are selected such that $V_1+V_2=0$ holds.

However, experiments showed that even when the above speed differences were so selected as to satisfy the condition of $V_1+V_2=0$, it was difficult to implement an image forming apparatus capable of surely canceling contraction and expansion.

Figure 3:
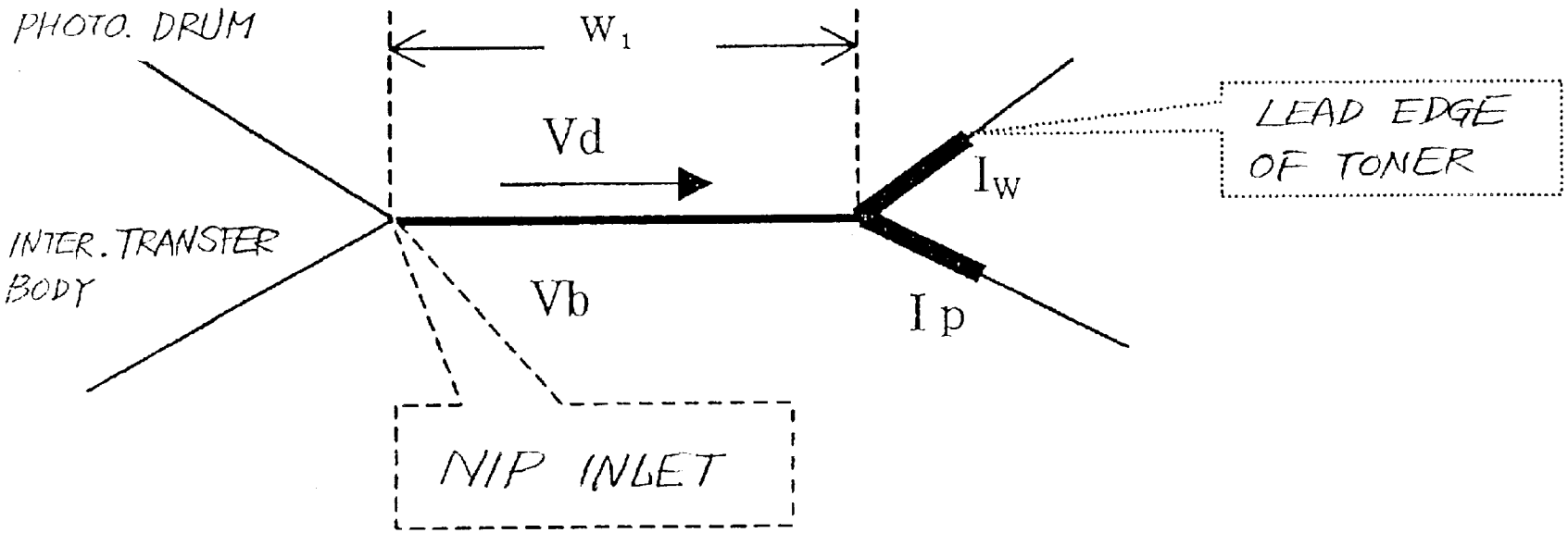
FIG. 3 PRIOR ART

As shown in FIG. 3, as for the electrophotographic process described in relation to [Problem 4] and to which the Eq. (1) applies, assume that a toner image has a width of 1p and that the linear velocity ratio Vb/Vd is α. Then, a period of time necessary for the toner image to fully move away from a nip width W is expressed as:

$$T=(W_1+Iw)/Vd=(W_1+Ip)/\alpha Vd \qquad \text{Eq. (11)}$$

A difference between the distance $W_1$+Iw from the inlet of the nip to the leading edge of the toner image and the distance $W_1$+Ip from the above inlet to the leading edge of the toner image on the intermediate image transfer body, i.e., (Iw−Ip) is representative of a difference between the line widths, i.e., an amount of expansion or contraction δI. Therefore, the Eq. (11) derives:

$$\delta I=Iw-Ip=(W_1+Iw)-(W_1+Ip)=T\ Vd(1-\alpha)=(W_1+Iw)(1-\alpha)=(W_1+Iw)(Vd-Vb)/Vd \qquad \text{Eq. (12)}$$

Consequently, there holds:

$$\delta I=(W_1+Iw)\cdot\Delta V/Vd=W_1\cdot\Delta V/Vd+Iw\cdot\Delta V/Vd \qquad \text{Eq. (13)}$$

As the Eq. (13) indicates, although the direction of the influence of the nip width $W_1$ on the expansion or the contraction of a toner image is dependent on the sign of the speed difference ΔV, pixels are thickened or expanded without regard to the speed difference ΔV.

Figure 4:
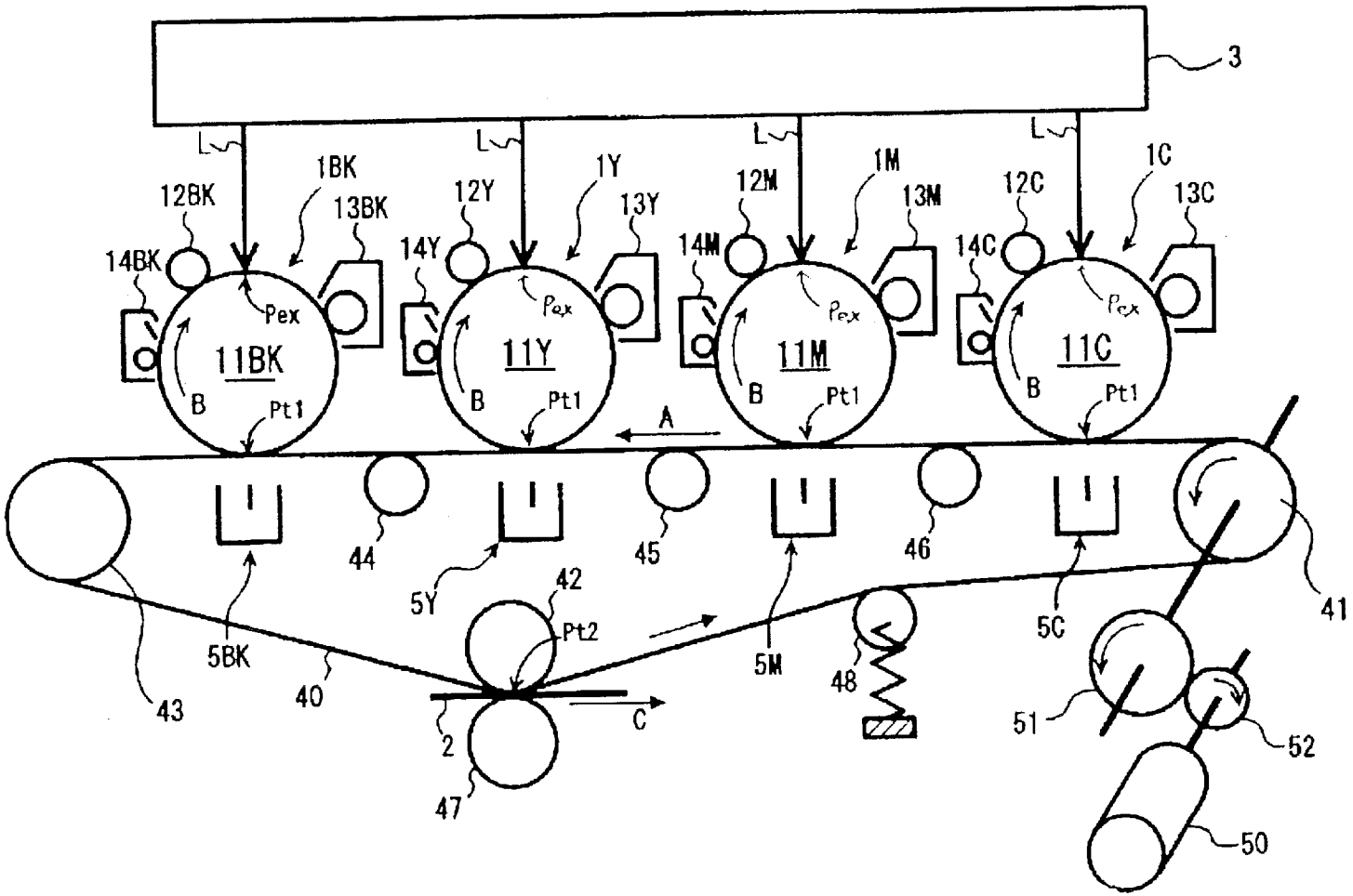
FIG. 4 is a view showing an image forming apparatus embodying the present invention.

Referring to FIG. 4, a tandem color image forming apparatus embodying the present invention is shown and includes four toner image forming sections 1C, 1M, 1Y and 1BK assigned to cyan (C), magenta (M), yellow (Y) and black (BK), respectively. The image forming sections 1C through 1BK are sequentially arranged in side by side in this order from the upstream side in a direction of movement of an intermediate image transfer belt or first image transfer body 40 indicated by an arrow A in FIG. 4. The image forming section 1C includes a photoconductive drum or image carrier 11C rotatable in a direction indicated by an arrow B, a charge roller or charging means 12C for uniformly charging the drum 11C, a developing unit or developing means 13C for developing a latent image formed on the drum 11C to thereby produce a corresponding toner image, and a cleaning unit 14C for cleaning the surface of the drum 11C. Likewise, the other image forming sections 1M, 1Y and 1BK respectively include photoconductive drums 11M, 11Y and 11BK, charge rollers 12M, 12Y and 12BK, developing units 13M, 13Y and 13BK, and cleaning units 14M, 14Y and 14BK.

The developing units 13C, 14M, 13Y and 13BK respectively develop latent images formed on the drums 11C, 11M, 13Y and 13BK with cyan, magenta, yellow and black toners for thereby producing corresponding toner images. The image forming sections IC through 1BK are arranged such that the axes of the drums 11C through 11BK are parallel to each other and arranged at a preselected pitch in the direction A.

An optical writing unit or latent image forming means 3 issues laser beams L in accordance with each image. Each laser beam L scans particular one of the drums 11C through 11BK to thereby form a latent image on the drum. There are also included in the apparatus sheet cassettes, a registration roller pair, an intermediate image transfer unit, a fixing unit and a print tray although not shown specifically. Image forming means assigned to each of the drums 11C through 11BK consists of the charge roller, developing unit, drum cleaning unit, and optical writing unit 3.

The optical writing unit 3 includes laser diodes, a polygonal mirror, an f-θ lens, and mirrors. The laser beams L modulated in accordance with image data each scans the surface of one of the drums 11C through 11BK, which are in rotation, in the main scanning direction at a preselected exposure position Pex.

The intermediate image transfer belt (simply belt hereinafter) 40 is included in the intermediate image transfer unit mentioned above. The belt 40 is passed over a drive roller or rotary drive body 41, a back roller 42 assigned to image transfer, a driven roller 43, and a tension roller 48 that applies preselected tension to the belt 40. The drive roller 41 causes the belt 40 to move in the direction A at preselected timing. Press rollers 44, 45 and 46 press the belt 40 against the surfaces of the drums 11C through 11BK with preselected pressure. Corona chargers for image transfer or first image transferring means 5C, 5M, 5Y and 5BK are positioned between the opposite runs of the belt 40 and applies charges for image transfer at first image transfer positions Pt1, which face the exposure positions Pex with the intermediary of the drums 11C through 11BK, thereby transferring toner images from the drums 11C through 11BK to the belt 40. At a second image transfer position Pt2 where the resulting composite image is to be transferred from the belt 40 to a sheet 2, a second image transfer roller or second image transferring means 47 faces the back roller 42 with the intermediary of the belt 40.

A motor or drive source 50 causes the drive roller 41 to rotate via a driveline including gears 51 and 52 or similar drive transmitting members.

In operation, the image forming section 1C, for example, causes the charge roller 12C to uniformly charge the surface of the drum 11C. The writing unit 3 scans the charged surface of the drum 11C with the laser beam L modulated in accordance with image data, thereby forming a latent image on the drum 11C. The developing unit 13C develops the latent image with cyan toner to thereby produce a cyan toner image. At the first image transfer position Pt1 via which the belt 40 moves, the cyan toner image is transferred from the drum 11C to the outer surface of the belt 40. After the image transfer, the drum cleaning unit 14C cleans the surface of the drum 11C. Subsequently, discharging means, not shown, discharges the surface of the drum 11C to thereby prepare it form the next image formation.

The sequence of steps described above is similarly executed with the other drums 11M, 11Y and 11BK in synchronism with the movement of the belt 40. The resulting toner images of different colors are sequentially transferred to the belt 40 one above the other, completing a color toner image.

The sheet 2, which is fed from any one of the sheet cassettes, is conveyed to a registration roller pair by feed rollers while being guided by guides, although not shown specifically. The registration roller pair stops the sheet 2 and then conveys it at preselected timing. The sheet 2 is then conveyed via the second image transfer position Pt2 where it faces the belt 40. The color toner image is transferred from the belt 40 to the sheet 2 at the second image transfer position Pt2, fixed by the fixing unit, and then driven out to the print tray, although not shown specifically.

Arrangements unique to the illustrative embodiment for reducing the expansion or the contraction of a line image (pixel) ascribable to various factors will be described hereinafter. In the following description applying to all of the colors C through BK, the suffixes Y through BK will be omitted, as needed.

Figure 5:
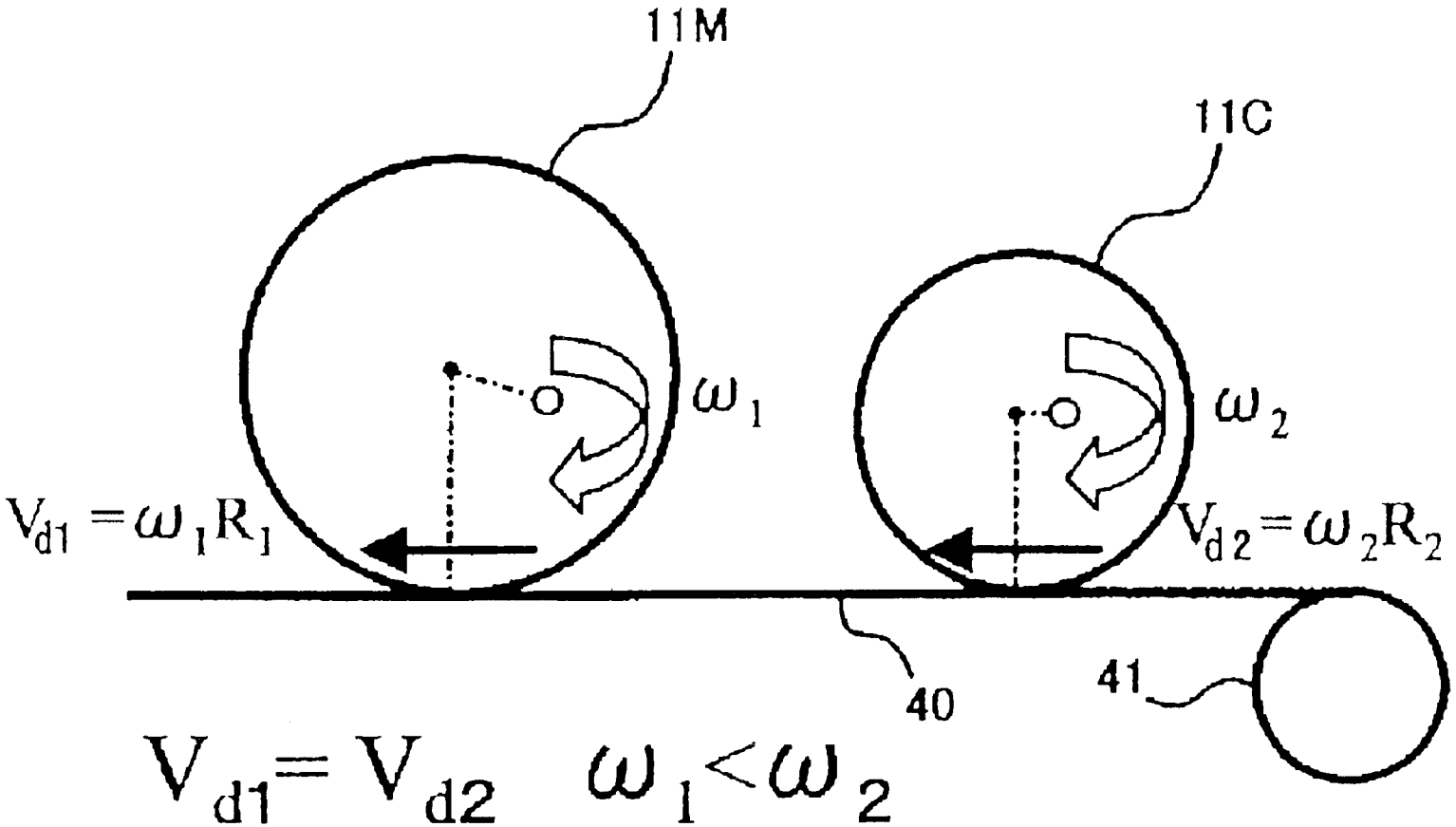
FIG. 5 is a view for describing control over the angular velocity of photoconductive drums included in the illustrative embodiment.
Figure 6:
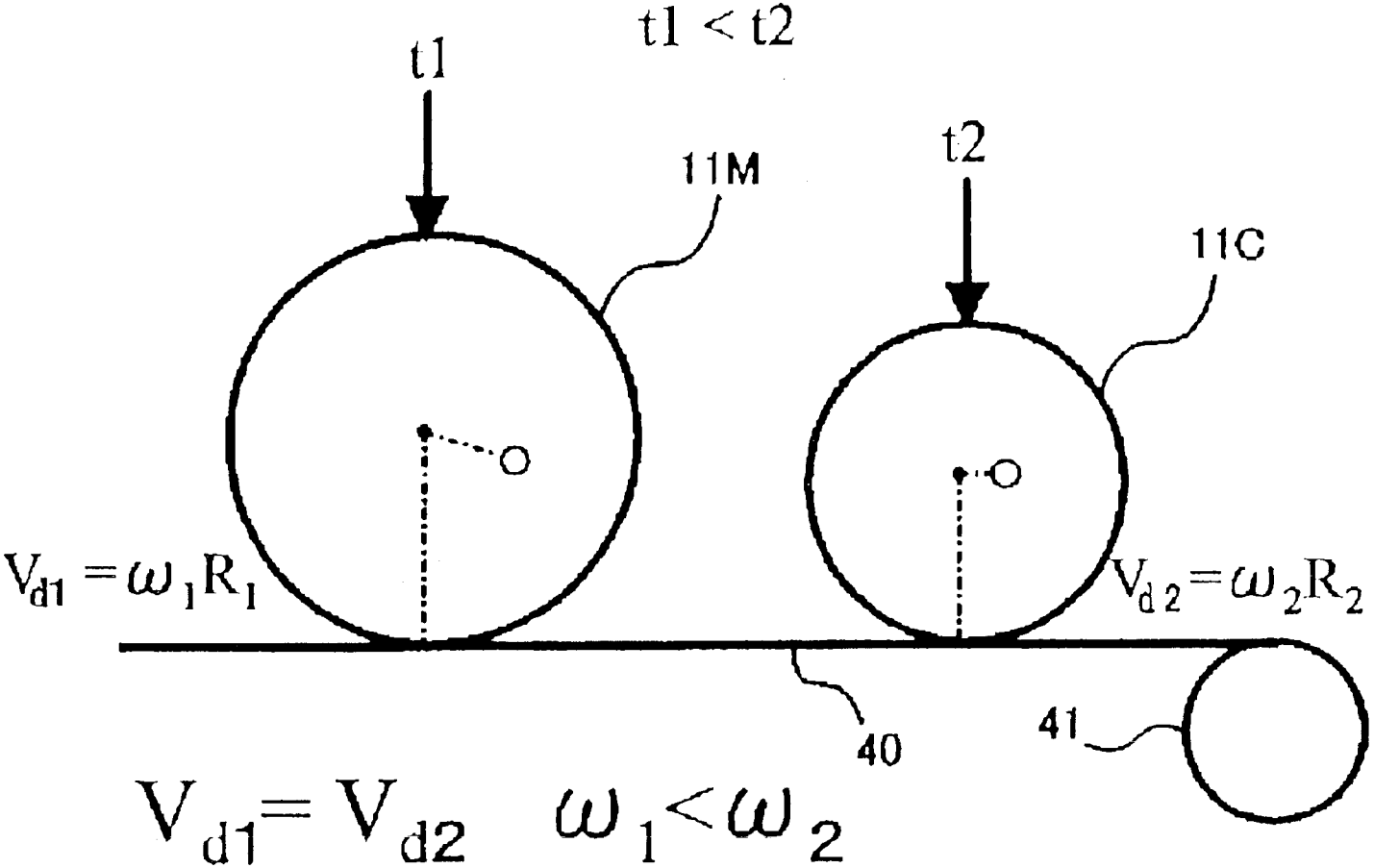
FIG. 6 is a view for describing timings for exposing the photoconductive drums included in the illustrative embodiment.

First, reference will be made to FIG. 5 for describing a specific measure against irregularity in drum radius available with the illustrative embodiment. As shown, drum drive sections, not shown, are so controlled as to vary the angular velocities ω1 and ω2 in accordance with the radius of the drum 11. Such control successfully reduces the variation of a speed difference or relative speed between the peripheral speed Vd of the surface of the drum 11 and the moving speed Vb of the surface of the belt 40 at the first image transfer positions Pt1. Further, as shown in FIG. 6, to obviate a color shift between the toner images transferred from the drums 11 to the belt 40, timings t1 and t2 at which the drums 11 are scanned are varied in accordance with the radius of the drum 11. In FIG. 6, t1 and t2 each indicate a period of time elapsed since a control reference time. For example, when a given drum 11 has a relatively large radius, the angular velocity of the drum 11 is lowered to thereby extend a period of time necessary for the exposed portion of the drum 11 to reach the first image transfer position Pt1. Therefore, image data are sent to the writing unit 3 at earlier timing for thereby advancing exposing timing.

When the radiuses of the drums 11 differ from each other by ΔRo. Then, when the angular velocities of the drums 11 are so controlled as to maintain the speed difference or relative speed at the first image transfer position Pt1 at ΔVh, the following advantage is achievable. When the drums 11 are free from irregularity in radius, the angular velocity ω for maintaining the peripheral speed is derived from (Ro+ΔRo)ω=Roωo, as follows:

$$\omega=\{Ro/(Ro+\Delta Ro)\}\omega o \qquad \text{Eq. (14)}$$

The length Ie of the exposed pixel on the drum 11 for a unit period of time is produced by Ie=(Ro+ΔRo)·ω=Roωo, meaning that the exposed pixel is not expanded. When the speed difference ΔV at the first image transfer position Pt1 is ΔVh, the line width of the image varies, i.e., increases or decreases by an amount of δI expressed as:

$$\begin{aligned}\delta I &= (W_1 + Iw)\cdot \Delta Vh/Vd \qquad \text{Eq. (15)}\\ &= (W_1 + Ro\omega o)\cdot \Delta Vh/(Ro\omega o)\\ &= W_1\cdot \Delta Vh/(Ro\omega o) + \Delta Vh\end{aligned}$$

where $W_1$ denotes the width of a nip for image transfer, and Iw denotes the line width of the image on the drum 11.

As the Eq. (15) indicates, even when the radius differs from one drum 11 to another drum 11, it does not effect the expansion or the contraction of the pixel.

Further, the illustrative embodiment protects the pixel from expansion and contraction ascribable to the periodic variation of the speed of the belt 40, as will be described hereinafter. The periodic speed variation of the belt 40 is ascribable to the eccentricity and cumulative tooth pitch error of the drive roller 41, gears included in the driveline extending from the motor, timing belt, pulleys and driven roller 43. As for a color shift ascribable to the periodic speed variation of the belt 40, assume that a period of time necessary for the belt 40 to move between nearby drums 11, i.e., between nearby first image transfer positions Pt1 is a natural number multiple of the period of the periodic speed variation. Then, the color shift can be obviated by the conventional technology. However, the surface speed or peripheral speed of each drum 11 and the surface speed of the belt 40 at each first image transfer position Pt1 sometimes periodically differ from each other. In this case, the expansion or the contraction of the pixel is apt to occur on the sheet 2, as stated earlier.

To reduce the expansion or the contraction of the pixel on the sheet 2, in the illustrative embodiment, an arrangement is made such that the mean surface speed or mean peripheral speed of each of the drums 11C through 11BK is equal to the speed at which the sheet 2 moves at the second image transfer position Pt2. Further, the distance between each of the consecutive first image transfer positions Pt1 and the second image transfer position Pt2 is selected such that a period of time necessary for the belt 40 to move the above distance is a natural number multiple of the period of speed variation of the belt 40. To further reduce the expansion or the contraction of the pixel, the distance between the second image transfer position Pt2 to each of the first image transfer positions Pt1 may also be selected such that a period of time necessary for the belt 40 to move the above distance is a natural number multiple of the period of speed variation of the belt 40.

Figure 7:
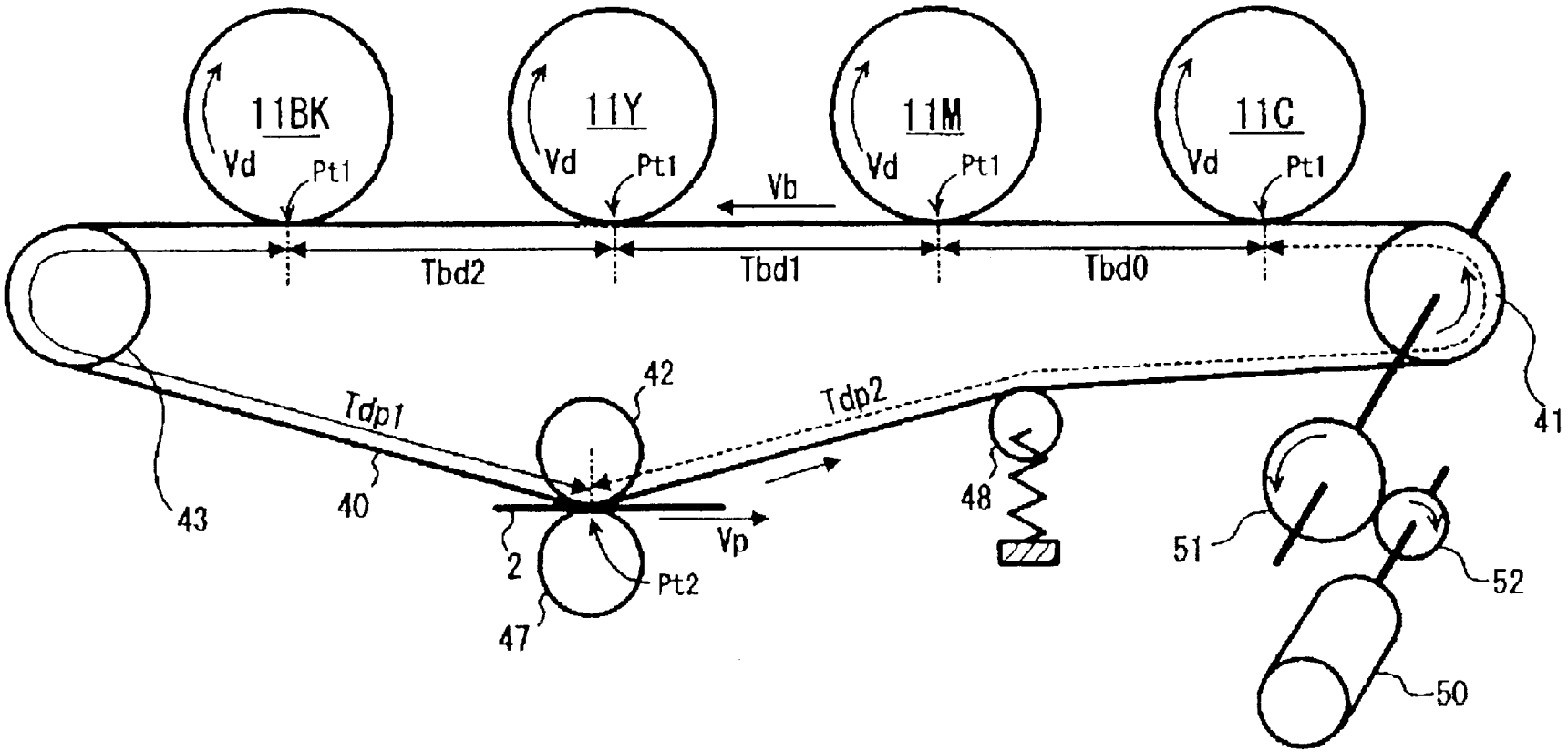
FIG. 7 is a fragmentary view of the illustrative embodiment.

Reference will be made to FIG. 7 for describing periods of time Tbd0, Tbd1, Tbd2, Tdp1 and Tdp2 necessary for the belt 40 to move between the image transfer positions. In FIG. 7, Tbd0 through Tbd2 each indicate a period of time necessary for the belt 40 to move between nearby first image transfer positions P1. Likewise, Tdp1 indicates a period of time necessary for the belt 40 to move from the first image transfer position Pt1 assigned to the drum 11BK, which is positioned at the most downstream side, to the second image transfer position Pt2. Further, Pdp2 indicates a period of time necessary for the belt 40 to move from the second image transfer position Pt2 to the drum 11C located at the most upstream side. A condition for reducing expansion and contraction is expressed as:

$$Vda=Vp$$

$$Tdp1=M1\times Tr$$

$$Tdp2=M2\times Tr$$

$$Tbd0=Tbd1=Tbd2=M3\times Tr \qquad \text{Eq. (16)}$$

where Vda denotes the mean surface speed or peripheral speed of the drum 11, Vp denotes the speed at which the sheet 2 moves at the second image transfer position Pt2, Tr denotes the period of speed variation of the belt 40, and M1 through M3 denote natural numbers.

So long as the above Eq. (16) is satisfied, the periods of time Tbd0 through Tdp2 each are the natural number of the speed variation of the belt 40. By addition a condition of Tdp2=M2×Tr, it is possible to make the individual frequency components of the period variation of the belt 40 more sinusoidal and therefore to further reduce expansion and contraction.

Even if the relation of Vda=Vp does not hold, a pixel contracted at any first image transfer position Pt1 is expanded at the second image transfer position Pt2 only if the following equation is satisfied:

$$Tdp1=M1\times Tr$$

$$Tdp2=M2\times Tr$$

$$Tbd0=Tbd1=Tbd2=M3\times Tr \qquad \text{Eq. (17)}$$

It will therefore be seen that expansion and contraction can be reduced even in the above case.

In the practical construction, the radius of the drive roller 41, the radiuses of gears included in the driveline, the length of the timing belt and the radius of the pulleys are so selected as to satisfy the condition represented by the Eq. (16) or (17).

As stated above, in the illustrative embodiment, the period of time necessary for the belt 40 to move from any of the first image transfer positions Pt1 to the second image transfer position Pt2 is a natural number multiple of the period of speed variation of the belt 40. Therefore, the belt 40 moves at the same speed when any pixel of the image formed on the drum 11 is transferred from the drum 11 to the belt 40 at the first image transfer position Pt1 and when the same pixel is transferred from the belt 40 to the sheet 2 at the second image transfer position Pt2. Moreover, the surface speed of the drum 11 is equal to the surface speed of the belt 40. These in combination make the speed difference between the drum 11 and the belt 40 at the first image transfer position Pt1 and the speed difference between the belt 40 and the sheet 2 at the second image transfer position Pt2 equal to each other. It follows that even when the speed of the belt 40 periodically varies, a pixel, e.g., expanded at the first image transfer position Pt1 due to the variation is contracted at the second image transfer position Pt2 by the amount of expansion. This successfully reduces the expansion or the contraction of the image on the sheet 2.

Assume a color image forming apparatus of the type forming a full-color image on the belt 40 by causing the same portion of the belt 40 to repeatedly move via the first image transfer positions Pt1. In this case, in the Eq. (16) or (17), it is preferable that the period of time necessary for the belt 40 to move from the second image transfer position Pt2 to the first image transfer position Pt1 is a natural number multiple of the period of speed variation of the belt 40. In this type of apparatus, when the portion of the belt 40 carrying a toner image arrives at any one of the first image transfer positions Pt1, just passing through the second image transfer position Pt2, any pixels of another toner image are transferred to the belt 40. At this instant, too, the additional condition stated above makes the moving speed of the belt 40 equal to the moving speed of the same at the second image transfer position, thereby reducing expansion or contraction.

Further, the illustrative embodiment is similarly applicable to a multiple transfer type of color image forming apparatus or a black-and-white type of image forming apparatus including a single photoconductive drum. In this type of apparatus, the distance between a first and a second image transfer position is selected such that a period of time necessary for an intermediate image transfer belt to move the above distance is a natural number multiple of the period of speed variation of the belt. Particularly, in the multiple transfer type of color image color image forming apparatus, the same portion of the belt repeatedly moves via the first image transfer position a plurality of times, so that a color image is formed on the belt. In this case, therefore, a period of time necessary for the belt to move from the second image transfer position to the second image transfer position is selected to be a natural number multiple of the period of speed variation of the belt.

Figure 8:
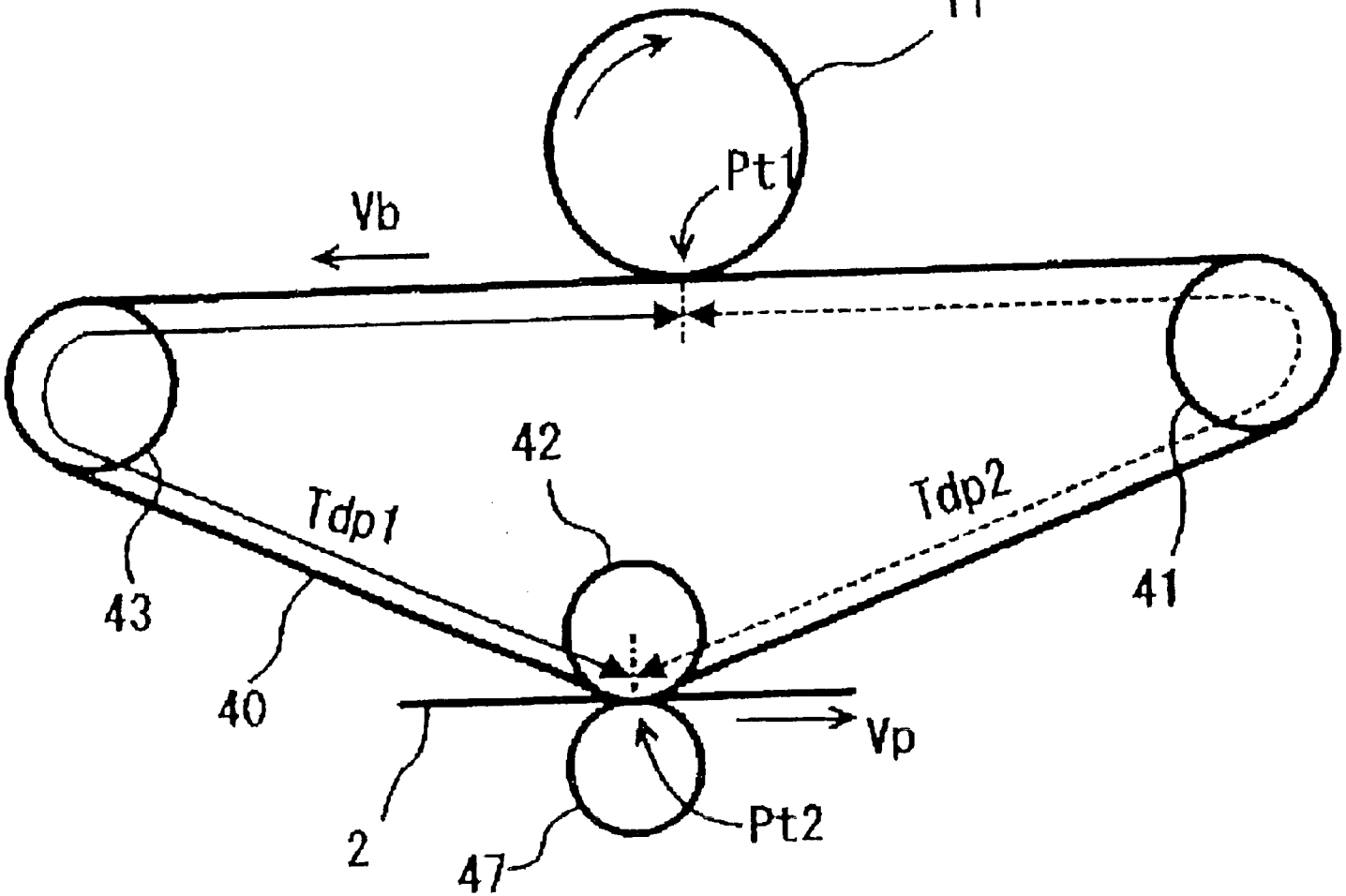
FIG. 8 is a fragmentary view showing a modification of the illustrative embodiment.

Referring to FIG. 8, there will be described periods of time Tdp1 and Tdp2 necessary for the belt 40 to move between the first and second image transfer positions Pt1 and Pt2 in the apparatus of the type including a single drum. In FIG. 8, Tdp1 indicates a period of time necessary for the belt 40 to move from the first image transfer position Pt1 to the second image transfer position in the direction of movement of the belt 40. Likewise, Tdp2 indicates a period of time necessary for the belt 40 to move from the second image transfer position Pt2 to the first image transfer position Pt1 in the above direction. By using these factors, a condition for obviating the expansion or the contraction of the above pixel is expressed as:

$$Vda=Vp$$

$$Tdp1=M\times Tr$$

$$Tdp2=L\times Tr \qquad \text{Eq. (18)}$$

where Vd denotes the mean surface speed or peripheral speed of the drum 11, Vp denotes the moving speed of the sheet 2 at the second image transfer position Pt2, Tr denotes the period of speed variation of the belt 40, and M and L denote natural numbers.

Even when the speed of the belt 40 periodically varies due to, e.g., the eccentricity of the drive roller 41, the above condition allows the belt speed at the first image transfer position Pt1 and the belt speed at the same image transfer position Pt2 to coincide for a given pixel. Even if Vda and Vp are not equal to each other, expansion and contraction are reduced if there hold Tdp1=M×Tr and Tdp2=L×Tr.

Another specific measure available with the illustrative embodiment against the expansion or the contraction of a pixel will be described hereinafter. The contraction $\delta I_2$ of a Pixel Ie=Roωo on the second image transfer body is produced by:

$$\delta I_2=(W_2+Ie)\cdot\Delta V_2/Vt_1$$

where $W_2$ denotes the nip width at the second image transfer position, $\Delta V_2$ denotes a relative speed of $\Delta V_2=Vt_1-V_2=Vb-V_2$ at the second image transfer position, $Vt_1$ denotes the linear velocity of the first image transfer body (=Vb), and $V_2$ denotes the linear velocity of the second image transfer body.

There holds a relation:

$$\Delta V_2+\Delta VH=\delta$$

or $$Vd=Vd_2+\delta$$

Therefore, there holds an equation:

$$\delta I_2=(W_2+Ie)\cdot\Delta V_2/Vt_1=W_2\cdot\Delta V_2/Vb+Ie\cdot\Delta V_2/Vb=W_2.(\delta-\Delta Vh-\delta U)/(\omega oRo-\Delta Vh-\delta U)+[Ro\omega o]^*(\delta-\Delta Vh-\delta U)/(\omega oRo-\Delta Vh-\delta U)$$

It is to be noted that δU and δV are respectively assumed to be the speed variations at the second and first image transfer positions because the period of time for forming the same pixel is different.

A total contraction E2 at the second image transfer position will be described hereinafter. At the second image transfer position, a pixel Iw1=Ie−E for a unit period of time is formed and contracted, resulting in the total contraction E2. More specifically, Ie of the pixel Iw1 formed on the second image transfer body is multiplied by $(1-\delta I_2/Ie)$ because $Ie-\delta I_2=Ie(1-\delta I_2/Ie)$ holds, the total contraction E is, of course, multiplied by the above value. Therefore, there hold:

$$Iw2=Ie-\delta I_2-E(1-\delta I_2/Ie)$$

$$E2=\delta I_2+E(1-\delta I_2/Ie)$$

Considering $\delta I_2/Ie<<1$, then:

$$E2=E+\delta I_2$$

The total contraction E2 represented by the above equation will be used hereinafter.

$$E2=E+\delta I_2=W_1\{Ro\omega o+(\Delta Vh+\delta V)\}/\{\omega o(Ro+\Delta Ro)\}+(\Delta Vh+\delta V)+W_2\cdot(\delta-\Delta Vh-\delta U)/(\omega oRo-\Delta Vh-\delta U)+[Ro\omega o]^*(\delta-\Delta Vh-\delta U)/(\omega oRo-\Delta Vh-\delta U)=W_1\cdot\{\Delta Ro\omega o+(\Delta Vh+\delta V\}/\{\omega o(Ro+\Delta Ro)\}+(\Delta Vh+\delta V)+W_2\cdot(\delta-\Delta Vh-\delta U)/(\omega oRo-\Delta Vh-\delta U)+(\delta-\Delta Vh-\delta U) \qquad \text{Eq. (19)}$$

where ωoRo>>ΔVh+δU holds.

In the Eq. (19), $W_1$ and $W_2$ respectively denote nip widths at the first and second image transfer positions, Ro and ΔRo respectively denote the radius of the drum 11 and scattering thereof, ωo denotes the angular velocity of the drum 11, ΔVh denotes a difference (=Vd−Vb) between the peripheral speed Vd of the drum 11 and the moving speed of the belt 40 provided at the first image transfer station Pt1 for obviating hollow characters, δ denotes a difference (=Vd−Vp) between the peripheral speed Vd of the drum 11 and the moving speed of the sheet 2, and δV and δU respectively denote the variations of the speed of the belt 40 at the first and second image transfer positions.

As the Eq. (19) indicates, if the influence of irregularity in drum radius is removed, if the drum peripheral speed Vd is maintained constant (=ωoRo), and if the drum, belt and second image transfer position are arranged in the relation of the Eq. (17) or (18), then δV is equal to δU. Therefore, the following equation holds:

$$E2=W_1\cdot(\Delta Vh+\delta V)/(\omega oRo)+W_2\cdot(\delta-\Delta Vh-\delta V)/(\omega oRo-\Delta Vh-\delta V)+\delta \qquad \text{Eq. (20)}$$

Further, when δ is zero, then E2 is zero if the following condition is satisfied:

$$E2=W_1\cdot(\Delta Vh+\delta V)/(\omega oRo)-W_2\cdot(\Delta Vh+\delta V)/(\omega oRo-\Delta Vh-\delta V)=0 \qquad \text{Eq. (21)}$$

The nip with $W_2$ at the second image transfer position Pt2 is produced by:

$$W_2=(\omega oRo-\Delta Vh-\delta V)\cdot W_1/(\omega oRo) \qquad \text{Eq. (22)}$$

Because δV varies, assuming that δV is zero, then the nip width $W_2$ is expressed as:

$$W_2=\{1-\Delta Vh/(\omega oRo)\}\cdot W_1 \qquad \text{Eq. (23)}$$

Assuming that the drum peripheral speed is Vdo when the drum radius and eccentricity are free from errors, then there holds a relation:

$$W_2/W_1=Vb/Vdo \text{ (or } W_1/W_2=Vdo/Vb) \qquad \text{Eq. (24)}$$

It follows that to reduce the total contraction E2 at the second image transfer position to zero, the nip widths $W_1$ and $W_2$ and sheet speed Vp should only be so selected as to satisfy:

$$\delta = Vd - Vp = 0$$

$$W_2/W_1 = Vb/Vdo \text{ (or } W_1/W_2 = Vdo/Vb) \quad \text{Eq. (25)}$$

With this configuration, it is possible to reduce the expansion or the contraction of a pixel ascribable to the periodic speed variation of the belt more than the conventional technologies.

Still another specific measure available with the illustrative embodiment for obviating the expansion or the contraction of a pixel will be described hereinafter. The expansion and contraction of a pixel ascribable to a speed difference or relative speed at each of the first and second image transfer positions Pt1 and Pt2 has been shown and described as being dependent on the nip width above. In practice, however, image transfer process conditions other than the nip width are different between the first and second image transfer positions Pt1 and Pt2. Expansion and contraction are therefore dependent on the image transfer process conditions other than the nip width as well. For example, when a lubricant is coated on the belt 40, the amount of expansion and that of contraction vary. Paying attention to this difference, the specific measure to be described defines influence coefficients $\kappa_1$ and $\kappa_2$ representative of the degrees of influence of the image transfer process conditions other than the nip width.

More specifically, the influence coefficients $\kappa_1$ and $\kappa_2$ respectively pertain to the first and second image transfer positions Pt1 and Pt2, and each is representative of a ratio of the dimension of a pixel expanded or contracted due to the influence of the image transfer process conditions other than the nip width and speed difference to the original dimension. For example, when zinc stearate or similar lubricant is coated on the belt 40 in order to enhance cleaning, the expansion or the contraction of a pixel ascribable to the speed difference at the image transfer position is reduced, i.e., the influence coefficient $\kappa_1$ or $\kappa_2$ becomes smaller than 1.

The influence coefficients $\kappa_1$ and $\kappa_2$ each are determined by exposing a basic pixel on the drum while maintaining the belt speed constant and varying the drum angular velocity, and measuring the width of a transferred pixel derived from the basic pixel. At this instant, the nip width is varied by varying the pressure of the image transfer roller. The image transfer process conditions will be described by using the influence coefficients $\kappa_1$ and $\kappa_2$ hereinafter.

The expansion or the contraction $\delta_{1\kappa}$ of a pixel at the first image transfer position Pt1 between the drum 11 and the belt 40 is expressed as:

$$\begin{aligned}\delta_{1\kappa} &= \kappa_1 \cdot \{W_1 + (Ro + \Delta Ro)\omega o\} \cdot (\Delta Ro\omega o + \Delta Vh + \delta V)/\{\omega o(Ro + \Delta Ro)\} \\ &= \kappa_1 \cdot W_1 \cdot (\Delta Ro\omega o + \Delta Vh + \delta V)/\{\omega o(Ro + \Delta Ro)\} + \kappa_1 \cdot (\Delta Ro\omega o + \Delta Vh + \delta V)\end{aligned} \quad \text{Eq. (26)}$$

At the first image transfer position Pt1, an error, i.e., a contraction $E_\kappa$ occurs due to the influence of the nip width $W_1$ and speed difference $\Delta Vh$:

$$E_\kappa = \kappa_1 \cdot W_1 \cdot (\Delta Ro\omega o + \Delta Vh + \delta V)/\{\omega o(Ro + \Delta Ro)\} + \kappa_1 \cdot (\Delta Vh + \delta V) + (\kappa_1 - 1) \cdot \Delta Ro\omega o \quad \text{Eq. (27)}$$

The specific measures against expansion and contraction stated earlier pertain to a condition wherein $\kappa_1$ is 1. When $\kappa_1$ is not 1, the correction of expansion or contraction to occur at the time of exposure due to the irregular drum radius, which is represented by the third member of the Eq. (27), is not available. This is also true with the eccentricity of the drum 11; expansion or contraction can be canceled when $\kappa_1$ is 1, but appears when $\kappa_1$ is not 1. Therefore, when $\kappa_1$ is not 1, there must be satisfied a condition of $\Delta Ro\omega o = 0$. This condition is equivalent to the fact that when the speed difference $\Delta Vh$ for obviating hollow characters and the belt speed variation $\delta V$ are zero, the speed difference must be made zero because the drums have eccentricity and irregular radiuses.

Hereinafter will be described the cancellation of the expansion or the contraction of a pixel at the first and second image transfer positions ascribable to the speed difference or relative speed between the drum 11 and the belt 40. While the following description concentrates on the irregularity in drum radius, eccentricity, if any, may be regarded as being added to the irregularity in drum radius. Eccentricity may be dealt with by a method which will be described later.

An Eq. (28) shown below gives a contraction $\delta I_2$ of a pixel on the sheet 2. Because the time for forming a given pixel differs from the first image transfer position to the second image transfer position, $\delta V$ and $\delta U$ are respectively assumed to be the speed variations of the belt 40 at the first and second image transfer positions.

$$\begin{aligned}\delta I_2 &= \kappa_2 \cdot (W_2 + Ie) \cdot \Delta V_2 / Vb \\ &= \kappa_2 \cdot W_2 \cdot \Delta V_2 / Vb + \kappa_2 \cdot Ie \cdot \Delta V_2 / Vb \\ &= \kappa_2 \cdot W_2 \cdot (\delta - \Delta Vh - \delta U)/(\omega oRo - \Delta Vh - \delta U) + \kappa_2 \cdot Ro\omega o \cdot (\delta - \Delta Vh - \delta U)/(\omega oRo - \Delta Vh - \delta U) \\ &\approx \kappa_2 \cdot W_2 \cdot (\delta - \Delta Vh - \delta U)/(\omega oRo - \Delta Vh - \delta U) + \kappa_2 \cdot (\delta - \Delta Vh - \delta U)\end{aligned} \quad \text{Eq. (28)}$$

Therefore, the total contraction E2 at the second image transfer position Pt2 is produced by:

$$\begin{aligned}E2 &= E_\kappa + \delta I_2 \\ &= \kappa_1 \cdot W_1 \cdot (\Delta Ro\omega o + \Delta Vh + \delta V)/\{\omega o(Ro + \Delta Ro)\} + \kappa_1 \cdot (\Delta Vh + \delta V) + (\kappa_1 - 1)\Delta Ro\omega o + \\ &\quad \kappa_2 \cdot W_2 \cdot (\delta - \Delta Vh - \delta U)/(\omega oRo - \Delta Vh - \delta U) + \kappa_2 \cdot (\delta - \Delta Vh - \delta U)\end{aligned} \quad \text{Eq. (29)}$$

The Eq. (29) indicates that if the influence of irregularity in drum radius is removed, if the drum peripheral speed is maintained constant ($\omega oRo$), and if the drum, belt and second image transfer position are held in the previously stated relation, then the relation of $\delta V = \delta U$ holds. The total contraction E2 may therefore be expressed as:

$$E2 = \kappa_1 \cdot W_1 \cdot (\Delta Vh + \delta V)/\{\omega oRo\} + \kappa_1 \cdot (\Delta Vh + \delta V) + \kappa_2 \cdot W_2 \cdot (\delta - \Delta Vh - \delta V)/(\omega oRo - \Delta Vh - \delta V) + \kappa_2 \cdot (\delta - \Delta Vh - \delta V) \quad \text{Eq. (30)}$$

E2=0 holds if the following conditions are satisfied:

$$\kappa_1 \cdot (\Delta Vh + \delta V) + \kappa_2 \cdot (\delta - \Delta Vh - \delta V) = 0 \quad \text{Eq. (31)}$$

$$\kappa_1 \cdot W_1 \cdot (\Delta Vh + \delta V)/\{(\omega oRo\} + \kappa_2 \cdot W_2 \cdot (\delta - \Delta Vh - \delta V)/(\omega oRo - \Delta Vh - \delta V) = 0$$

$$W_1/\{\omega oRo\} - W_2/(\omega oRo - \Delta Vh - \delta V) = 0$$

$$W_1/\{\omega oRo\} = W_2/(\omega oRo - \Delta Vh - \delta V) \quad \text{Eq. (32)}$$

Neglecting the variation $\delta V$ of the belt speed included in the Eq. (31), there holds:

$$\kappa_1 \cdot \Delta Vh = \kappa_2 \cdot (\Delta Vh - \delta)$$

$$\delta = (1 - \kappa_1/\kappa_2) \cdot \Delta Vh$$

$$\kappa_2 \cdot \delta = \Delta\kappa \cdot \Delta Vh$$

$$\Delta\kappa = \kappa_2 - \kappa_1 \qquad \text{Eq. (33)}$$

While the variation of the belt speed in the Eq. (32) is an error, assuming that δV is zero, then there holds:

$$W_2 = W_1 \cdot \{(1 - \Delta Vh/(\omega o Ro)\} \qquad \text{Eq. (34)}$$

Assuming that the peripheral speed of the drum 11 is Vdo when the drum 11 is free from errors in radius and eccentricity, then the following relation holds:

$$W_2/W_1 = Vb/Vdo \qquad \text{Eq. (35)}$$

It suffices to determine the nip width $W_2$ at the second image transfer position in accordance with the above equations. Further, if the moving speed of the sheet 2 and nip width $W_2$ at the second image transfer position Pt2 are so selected as to satisfy the conditions of the Eqs. (31) and (32), then image quality with a minimum of pixel expansion or contraction is achievable.

Next, a specific measure against the expansion and contraction of a pixel ascribable to drum eccentricity and implemented by, e.g., image data correction will be described hereinafter together with the influence of irregularity in drum radius. As for an error in drum eccentricity, image data are corrected by sensing the angle and amplitude of eccentricity. This principle is disclosed in Laid-Open Publication No. 2001-337561 mentioned earlier together with irregularity in drum radius.

Figure 9:
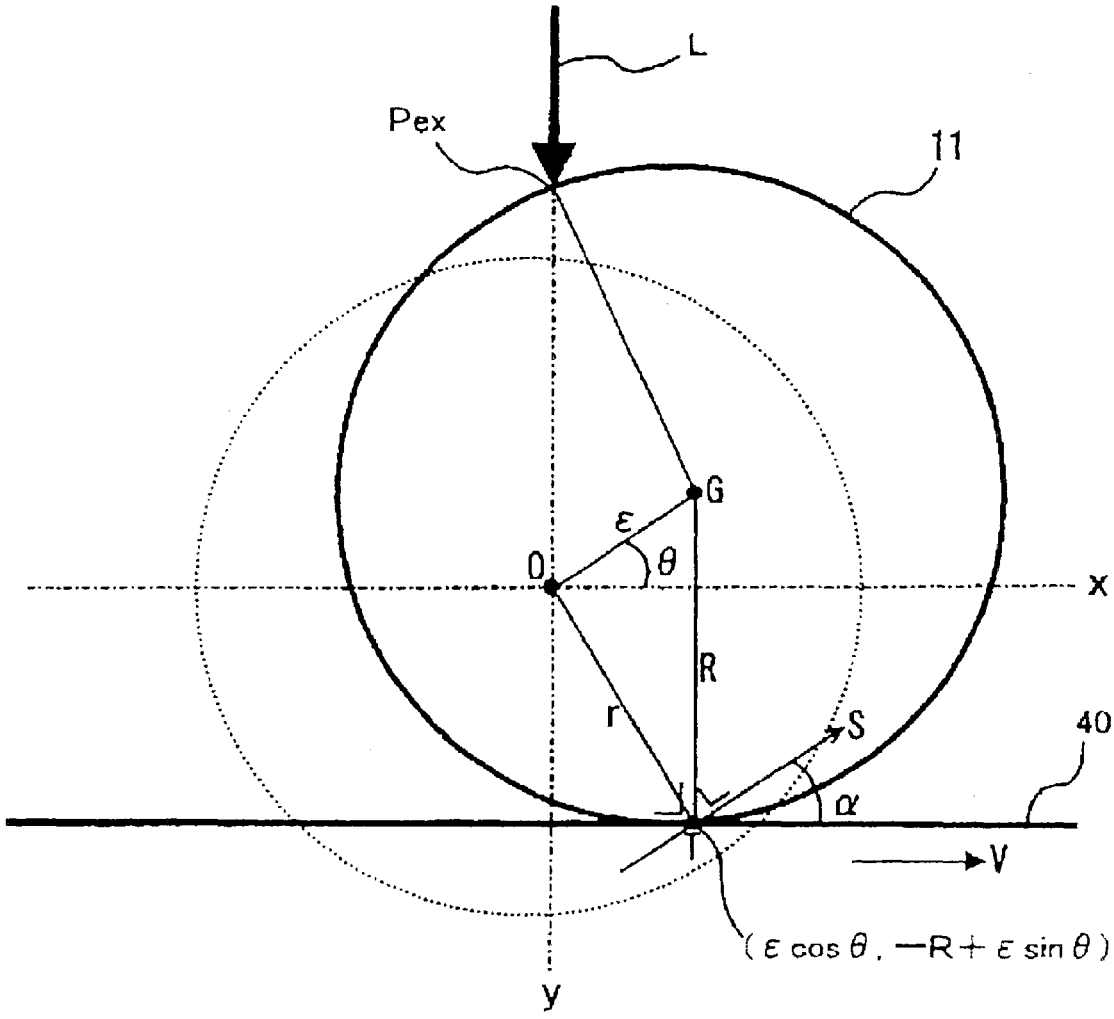
FIG. 9 is a view modeling one of the photoconductive drums included in the illustrative embodiment.

Assume a model shown in FIG. 9 in which ϵ and θ denote the amount of eccentricity and the angle of an eccentricity position from an x axis, respectively. A moving speed at a point T where the belt and drum contact each other is produced, in terms of coordinates, by:

$$(-\epsilon \sin\theta \cdot \omega,\ \epsilon \cos\theta \cdot \omega),\ \omega = d\theta/dt \qquad \text{Eq. (36)}$$

A velocity Vs in a direction S rotating around the axis O of the drum is expressed as:

$$Vs = V \cos\alpha - \epsilon \sin\theta \cdot \omega \cdot \cos\alpha + \epsilon \cos\theta \cdot \omega \cdot \sin\alpha \qquad \text{Eq. (37)}$$

where V denotes the moving speed of the belt, and α denotes an angle between a virtual line r connecting the axis O and the point T and the belt surface. Therefore, the angular velocity ω of the drum 11 is produced by:

$$\omega = Vs/r \qquad \text{Eq. (38)}$$

$$= (V\cos\alpha - \varepsilon\sin\theta \cdot \omega \cdot \cos\alpha + \varepsilon\cos\theta \cdot \omega \cdot \sin\alpha)/r$$

A cosine formula derives:

$$r^2 = R^2 + \epsilon^2 - 2R\epsilon \cos(\pi/2 - \theta) = R^2 + \epsilon^2 - 2R\epsilon \sin\theta \qquad \text{Eq. (39)}$$

where R denotes the radius of the drum 11.

Also, a sine formula derives:

$$\epsilon/\sin\alpha = r/\sin(\pi/2 - \theta) = r/\cos\theta \qquad \text{Eq. (40)}$$

$$\sin\alpha = \epsilon\cos\theta/r,\ \cos\alpha = (R - \epsilon\sin\theta)/r \qquad \text{Eq. (41)}$$

By substituting the Eqs. (39) and (41) for the Eq. (38), there is obtained:

$$\omega = \{V \cdot R - (V + \omega R)\varepsilon\sin\theta + \omega\varepsilon^2\}/(R^2 + \varepsilon^2 - 2R\varepsilon\sin\theta)$$
$$\omega(R^2 + \varepsilon^2 - 2R\varepsilon\sin\theta) = V \cdot R - (V + \omega R)\varepsilon\sin\theta + \omega\varepsilon^2$$
$$V = R\omega \qquad \text{Eq. (42)}$$

If the first image transfer position between the drum 11 and the belt 40 is set as shown in FIG. 9 and if the moving speed V of the belt 40 and the angular velocity ω of the drum 11 satisfy a relation of V=Rω, then a slip-free condition is obtained even when the drum 11 has eccentricity. If there hold Vv=V+ΔVh and V=Rω where Vv denotes the moving speed of the belt 40, then a slip speed or relative speed at the first image transfer position remains constant at ΔVh. In this specific configuration, the speed difference or relative speed between the drum 11 and the belt 40, in principle, satisfies the same condition as during following rotation and is therefore constant. This is because the image transfer position moves to correct the speed difference between the drum 11 and the belt 40 tending to occur at the first image transfer position due to the eccentricity of the drum 11.

Figure 10:
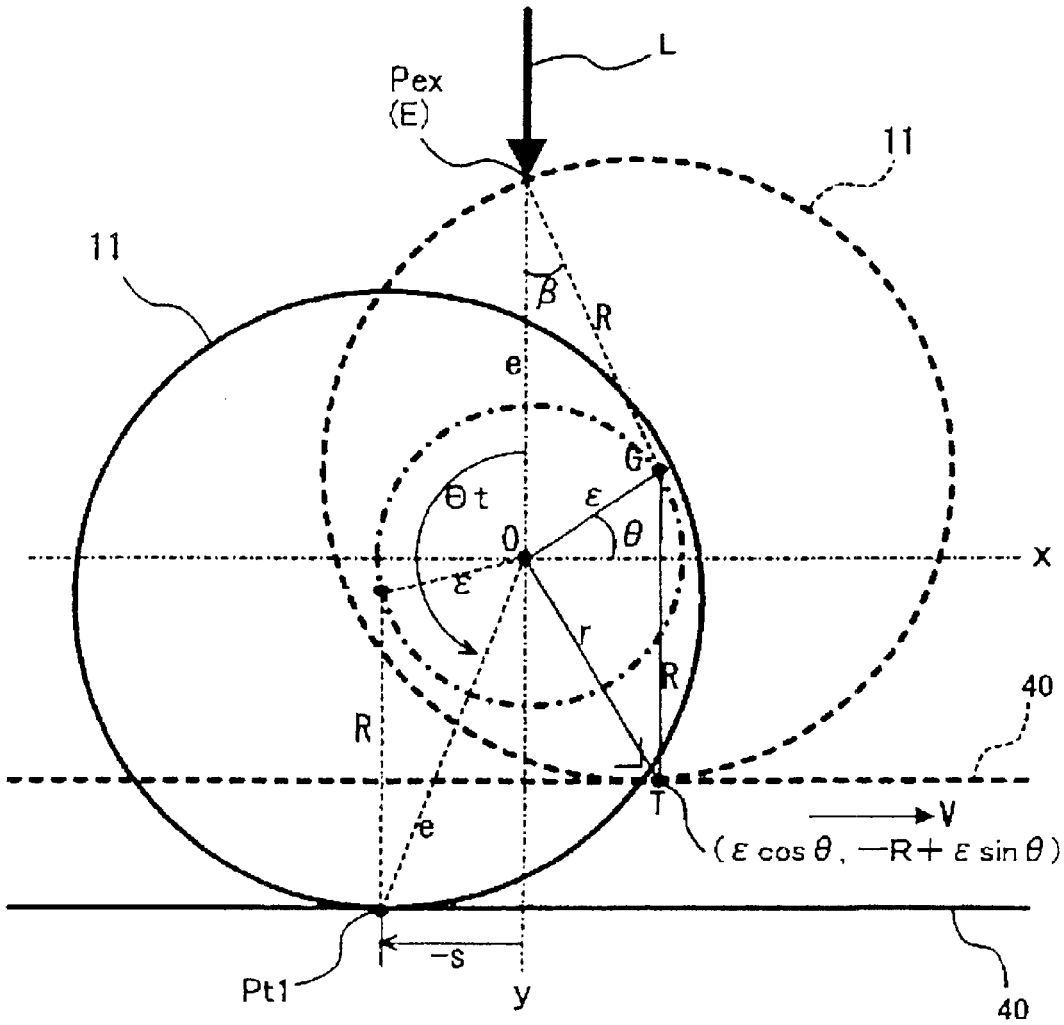
FIG. 10 is a view for describing a timing for generating image data and the setting of an exposure position.

Hereinafter will be described a method of generating image data when the drum has eccentricity and irregularity in radius. As shown in FIG. 10, an angle Θt from the exposure position Pex to the first image transfer position Pt1 is measured. In FIG. 10, the image transfer position is determined by a triangle OGE indicated by a dotted line and determined at the moment of exposure. More specifically, an image exposed at a position where the center of gravity G of the drum is positioned at an angle of θ (angle GOx) is rotated by the angle Θt and then transferred at a position (x=−s) shifted from an ideal image transfer position (x=o). s=(ϵ/R)(R+ϵ sin θ)cos θ from FIG. 10.

The rotation angle Θt of the drum 11 from the exposure to the image transfer is expressed as:

$$\Theta t = \pi - \beta \qquad \text{Eq. (43)}$$

where β denotes an angle GEO. By using an Eq. (44) shown below and representative of a relation between the angles β and θ, the rotation angle Θt may be expressed as:

$$\sin\beta = (\epsilon/R)\cos\theta \qquad \text{Eq. (44)}$$

$$\Theta t = \pi - \sin^{-1}\{(\epsilon/R)\cos\theta\} \qquad \text{Eq. (45)}$$

If the point where the belt 40 and drum 11 contact each other is coincident with the maximum value or apex of the drum 11, as seen in a section, adjoining the belt 40, then the rotation angle Θt can be stably determined. By using the resulting data, it is possible to generate high-quality image data free from image distortion and color shifts.

As for the generation of the image data, the timing for generating a main scanning image is adjusted such that a pixel expected to be present at the ideal image transfer position is transferred to the ideal image transfer position without fail. When the drum 11 has an ideal drum radius Ro, a pixel is transferred after the drum 11 has moved by πRo. However, when the drum 11 has eccentricity and irregularity in radius, the pixel is transferred after the drum 11 has moved by Θt, i.e., the image transfer position is shifted from the ideal image transfer position T by −s.

The image transferred to the belt 40 moves at the speed V. The image data is transferred at the above shifted position in a period of time of Θt/ω)τ after exposing an image.

Assuming that the drum 11 moves at an angular velocity of ωo when it has the ideal radius Ro, then there holds:

$$V = Ro\omega o \qquad \text{Eq. (46)}$$

If the drum 11 is ideally configured, then an image should be transferred in a period of time of $\Theta/\omega o=\tau o$ after exposing an image. It follows that an image expected to be present at $x=V\tau o$ on the belt 40 appears at $x=V\tau$. If the belt moved a distance s in a period of time $\tau o-\tau$, the ideal image transfer position would actually be obtained. However. a distance f that the belt can move in a period of time $\tau o-\tau$ is $f=V(\tau o-\tau)$. Therefore, an error of the transfer position relative to the ideal image transfer position can be expressed as $d=s-f$. That is, if image data corresponding to $x=V\tau+s=V\tau o+d$ is generated at the exposure side, then an ideal image is attained. Eventually, data expected to appear d before should only be generated.

$$V = R\omega = Ro\omega o \quad \text{Eq. (47)}$$

$$\Theta t = \pi - \sin^{-1}\{(\varepsilon/R)\cos\theta\} \quad \text{Eq. (48)}$$

$$f = V(\pi/\omega o - \Theta t/\omega)$$

$$= R\cdot[\pi\omega/\omega o - \pi + \sin^{-1}\{(\varepsilon/R)\cos\theta\}] \quad \text{Eq. (49)}$$

$$d = (\varepsilon/R)(R+\varepsilon\sin\theta)\cos\theta \quad \text{Eq. (50)}$$

It will therefore be seen that when the drum 11 is free from eccentricity, image data should only be generated by being shifted by $d=\pi(Ro-R)$. When the drum radius is scattered to the larger radius side, image data expected to appear later by d should only be generated. In this case, the peripheral speed V of the drum 11 remains constant, so that the main scanning pitch is also constant. More specifically, it suffices to shift the image data by d in accordance with the Eq. (50). It is to be noted that the image data is advanced or delayed in accordance with the drum radius, drum eccentricity and angle θ.

When the exposure position differs from one shown in FIG. 10, there should only be generated image data delayed or advanced relative to FIG. 10 by a period of time corresponding to the rotation angle to the exposure position Pex (E) shown in FIG. 10. Therefore, when a speed reference or relative speed is provided between the drum 11 and the belt 40 at the first image transfer position for obviating hollow characters, if the belt speed is shifted from the reference speed, then the image data generating timing should only be shifted by d corresponding to the Eq. (50). Further, to correct irregularity in the distance between nearby drums, the image data generating timing may be shifted by a period of time corresponding to a difference or error between the ideal period of time over which the belt moves between the drums and the actual period of time.

If desired, the scanning position in the subscanning direction may be shifted by d in place of the image data. As for the writing unit 3 of the type scanning the drum with a laser beam by use of a polygonal mirror, an angularly movable mirror having a length greater than the main scanning width may be positioned just before the exposure position and driven to shift the light beam in the subscanning direction. If the writing unit 3 uses an LED (Light Emitting Diode) array, then a mechanism for shifting the exposing position of the LED array may be used or the exposing timing may be shifted in the main scanning direction.

A configuration for stabilizing the speed difference or relative speed between the drum 11 and the belt 40 at the first image transfer position will be described hereinafter. The center of the nip between the drum 11 and the belt 40 should preferably be coincident with the maximum value or apex of the drum 11 adjoining the belt 40. This allows the above relative speed to remain substantially constant or allows the drum 11 and belt 40 to move substantially integrally without any slip. The center of the nip between the drum 11 and the belt 40 is surely moving integrally without any slip.

The belt 40 should preferably be implemented as either one of a single layer and a laminate and provided with a flexible or elastic surface. For example, the belt 40 may be made up of a base formed of, e.g., polyimide and an elastic layer formed of elastic rubber, typically conductive silicone rubber. A surface layer that promotes parting of toner or cleaning may be formed on the elastic layer. Such a structure increases the rigidity of the belt 40 in the direction of movement and provides the belt 40 with flexibility or elasticity in the direction of thickness.

Figure 11B:
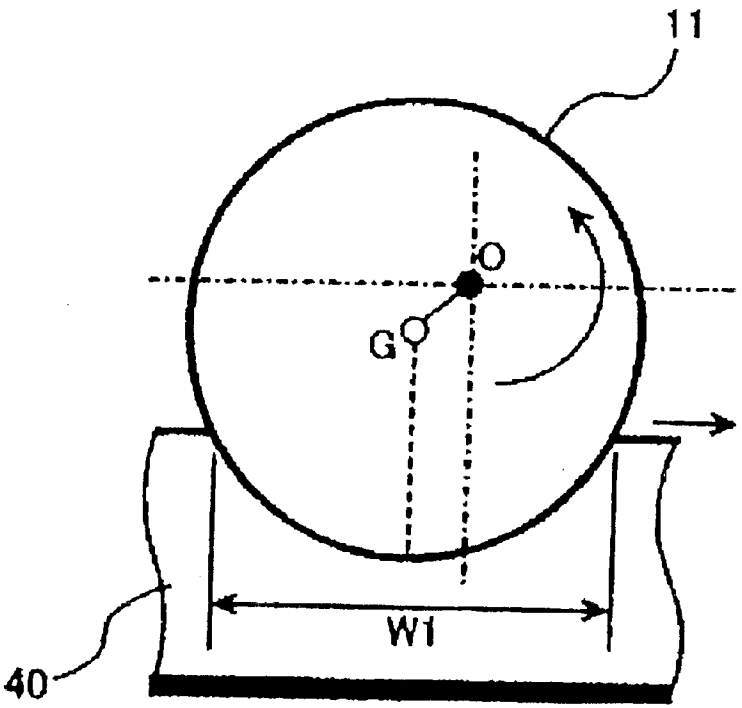
FIGS. 11A and 11B are views demonstrating how a nip width for image transfer varies when the drum with eccentricity rotates.
Figure 11A:
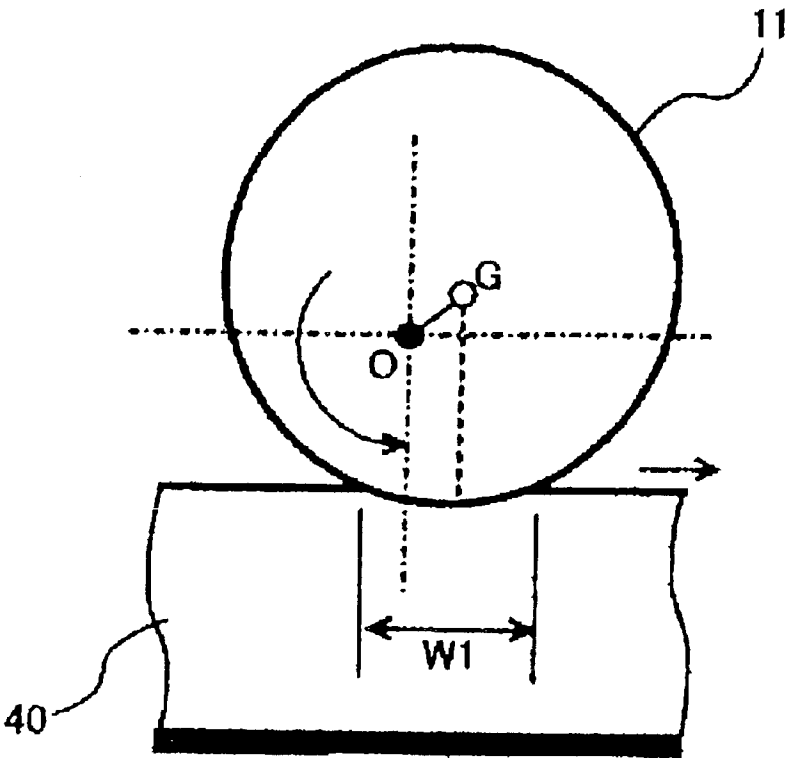

When the belt 40 has the above structure, the maximum value or apex mentioned earlier is positioned at the center of the nip width $W_1$ in FIGS. 11A and 11B. Therefore, by controlling the angular velocity of the drum 11 constant, it is possible to maintain, even if the drums 11 are eccentricity and irregular in radius, the speed difference or relative speed between the drum 11 and the belt 40 substantially constant or to cause the surfaces thereof to slide substantially integrally with each other. As for the eccentricity of the drum 11, the speed difference or relative speed around the center of the nip width $W_1$ becomes constant or the two surfaces slide integrally with each other there.

Figure 12B:
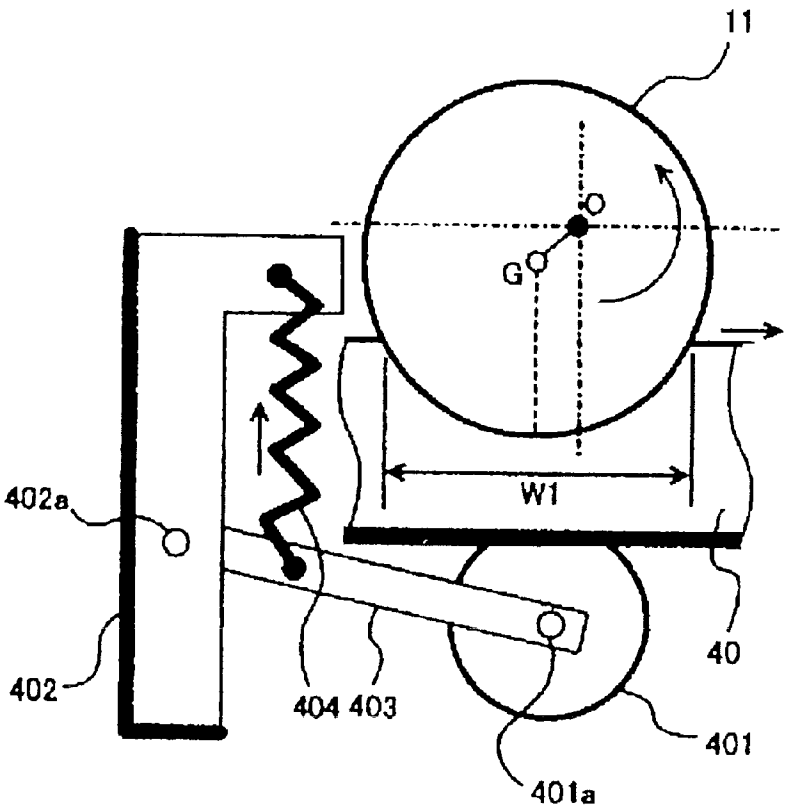
FIGS. 12A and 12B are views showing a pressing mechanism included in the illustrative embodiment.
Figure 12A:
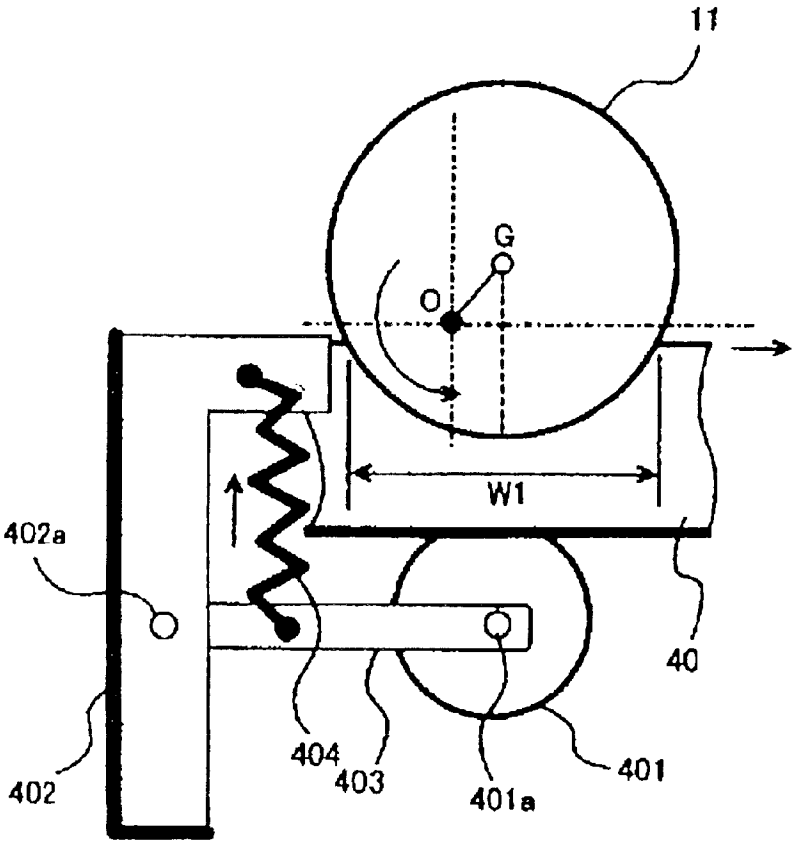

When the nip width W1 varies due to eccentricity, it is likely that the expansion or the contraction of a pixel varies. In light of this, as shown in FIGS. 12A and 12B, the corona charger 5 for image transfer may be replaced with a primary image transfer roller or first image transferring means 401 pressed against the rigid base of the belt 40. The image transfer roller 401 is capable of pressing the flexible or elastic surface of the belt 40 against the drum 11 with preselected pressure. In this condition, even when the drum 11 with irregular radius or eccentricity is rotated, the flexible or elastic surface of the belt 40 bites into the drum 11 in substantially a constant amount, so that the nip width $W_1$ is maintained substantially constant. In this case, the prerequisite is that the amount of deformation of flexure of the surface of the belt 40 be so selected as to maintain the amount of bite of the belt surface into the drum 11 substantially constant. More specifically, it is necessary to select the flexibility or elasticity of the belt surface and the tension and rigidity of the belt in such a manner as to satisfy the above condition.

In the configuration shown in FIGS. 12A and 12B, the primary image transfer drum 401, a stationary frame 402, an angularly movable arm 403 and a spring 404 constitute a mechanism for pressing the belt 40 against the drum 11 with preselected pressure. This configuration is only illustrative, but not restrictive. In FIGS. 12A and 12B, one end of the arm 403 is rotatably supported by a shaft 402*a* mounted on the frame 402. The other end of the arm 403 is supported by the shaft 401*a* of the image transfer roller 401. The spring 404 is anchored to the frame 402 at one end and anchored to the intermediate portion of the arm 403 at the other end, constantly biasing the arm 403 counterclockwise, as viewed in FIGS. 12A and 12B. The image transfer roller 401 is rotatably mounted on the arm 403, as illustrated.

Figure 13:
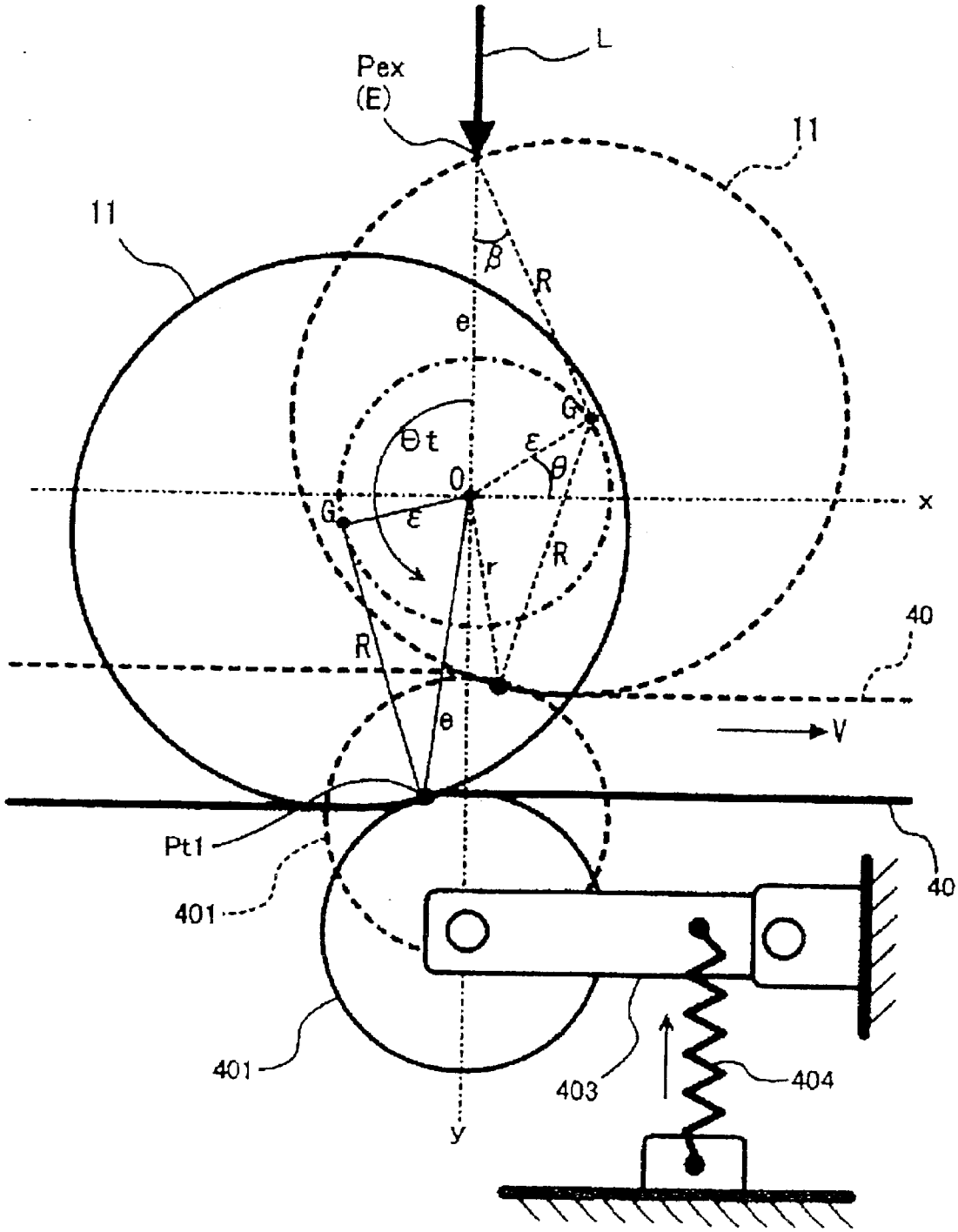
FIG. 13 PRIOR ART
FIG. 13 is a view modeling a photoconductive drum and other members arranged at a first image transfer position included in the conventional apparatus.

FIG. 13 shows a conventional configuration for comparison. As shown, when the drum 11 has eccentricity and when the surface of the belt 40 has little flexibility or elasticity, the first image transfer position Pt1 is not coincident with the maximum value or apex of the drum 11, as seen in a section, adjoining the belt 40. In this condition, a torque is transferred to the drum 11 with the belt 40 being pressed against the drum 11 by the first image transfer roller 401. Further, the first image transfer position Pt1 is close to a position vertically beneath the axis O of the drum 11, i.e., closer to a y axis than in the illustrative embodiment. It will therefore be seen that the speed difference or relative speed at the first image transfer position varies due to the eccentricity of the drum 11.

The configuration shown in FIGS. 12A and 12B similarly applies to the second image transfer position Pt2 if the secondary image transfer roller 47 with a fixed shaft is substituted for the drum 11 and if the back roller 42 is substituted for the primary image transfer roller 401. In this configuration, the sheet 2 is passed via the nip between the secondary image transfer roller 47 and the belt 40. Further, when the sheet or second image transfer body 2 is replaced with an intermediate image transfer drum or similar rotary body, it suffices to substitute the rotary body with a fixed axis for the drum 11.

As stated above, the illustrative embodiment makes the speed difference or relative speed during image formation smaller than the conventional technologies. In a conventional arrangement, a point where a virtual line extending through the axis O of the drum 11 perpendicularly intersects the belt 40 is selected to be the center of image formation, so that the center of the nip width is not coincident with the center of image formation. As a result, a speed difference occurs between the drum 11 and the belt 40 around the center of image formation.

Control over the drive of the drums 11 and belt 40 unique to the illustrative embodiment will be described hereinafter. The illustrative embodiment includes signal generating means for generating a signal corresponding to a pixel pitch in the subscanning direction (subscanning pitch hereinafter) in synchronism with the movement of the belt 40. The signal generating means is implemented by an encoder for sensing a rotation angle. The above signal appears at a timing which is, e.g., N or 1/N times (N being a natural number) as great as the subscanning pitch. Sensing means responsive to an exposure start position is assigned to the belt 40. Sensing means for sensing the reference position of a rotation angle by generating a single pulse for a single rotation and an encoder for sensing a rotation angle are assigned to each of the drums 11. Further, a motor or drive source 50 is assigned to the belt 40 and driven by the signal output from the signal generating means.

A driveline including a motor is associated with each drum 11 and controlled such that the difference between the mean peripheral speed of the drum 11 and the moving speed of the belt 40, as measured at the first image transfer position, remains substantially constant or they stably move integrally with each other without any slip.

In the illustrative embodiment, the drum 11 is rotated at a preselected angular velocity while the belt 40 is moved at a constant speed. In addition, the maximum value or apex of the drum 11, as seen in a section, coincides with the center of the nip for image transfer at the first image transfer position Pt1. The angular velocity of the drum 11 is varied in accordance with irregularity in the radius of the drum 11 to thereby control the rotation of the drum such that the drum 11 and belt 40 move at a constant relative speed or integrally with each other. For this purpose, control is executed such that the interval between pulses sequentially output from the sensing means, which generates a single pulse for a single rotation of the drum 11, corresponds to the constant speed difference or the speed at which the drum 11 and belt 40 move integrally with each other. Alternatively control may be executed such that the interval between pulses sequentially output from the encoder, which senses the rotation angle of the drum 11, corresponds to the above speed.

Specific procedures for sensing the eccentricity $\epsilon$ and radius R of each drum 11 will be described hereinafter.

<Self-Measurement>

The radius R of the drum 11 can be determined if the belt 40 is moved by a distance of $L=2\pi Ro$ corresponding to the circumferential length of an ideal drum while the resulting rotation angle $i\theta$ of the encoder directly connected to the drum 11 is detected. The radius R is expressed as:

$$R=L/\theta i \qquad \text{Eq. (51)}$$

Alternatively, if only the reference position is available due to the absence of the encoder, then a distance Lb over which the belt 40 moves when the drum 11 completes one rotation may be determined, as follows:

$$R=Lb/(2\pi) \qquad \text{Eq. (52)}$$

Further, use may be made of a sensor responsive to the movement or the absolute position of the belt 40. For example, use may be made of a linear encoder configured to identify the absolute position by sensing marks put on the portion of the belt 40 outside of a sheet contact area and a mark also put on the belt 40 and indicative of the reference position of the belt 40. With this sensor, even if the encoder capable of sensing the absolute position of the drum 11 is absent, it is possible to estimate the angular position of each drum 11 only if a rotation angle and reference position sensor is available, which outputs a single pulse for a single turn of the belt 40. More specifically, while the drum 11 is in rotation, the linear encoder measures one period of drum rotation output from the above rotation angle and reference position sensor. It is therefore possible to measure the radius R of the drum 11 as well. If the angular velocity of each drum 11 is controlled to a preselected value in matching relation to a disk radius, then it is possible to obviate the speed difference or the slip at the image transfer position.

To measure the position of eccentricity $\epsilon$ of the drum 11, the displacement of the circumference of the drum 11 ascribable to eccentricity may be sensed by a sensor, which may be made up of a light-emitting device, a light-sensitive device, and optics. The light-emitting device emits a light beam toward a displacement sensing position on the circumference of the drum 11 while the light-sensitive device receives the light beam reflected by the drum 11 and may be implemented as a bisected photodiode device. The optics causes the reflection incident on the light-sensitive device to vary when the drum circumference is displaced due to eccentricity. For example, the optics maybe implemented as one using, e.g., a focus error sensing system customary with an optical disk. In this configuration, when the distance between the sensing positions varies, a photocurrent corresponding to the variation flows through the light-sensitive device and is indicative of the amount of eccentricity of the drum 11. Further, an eccentricity position ($\theta$, $\epsilon$) from the x axis can be determined if the peak of the variation of the output signal occurred when the drum 11 is rotated is detected while the resulting rotation angle information is detected.

In the illustrative embodiment, it suffices to determine a position where the eccentricity position ($\theta$, $\epsilon$) is located in the rotation angle of the drum 11. More specifically, because the rotation angle of the drum 11 is sensed by another means, it suffices to locate the above position and determine the amplitude $\epsilon$.

<Measurement in Factory>

There are measured the radius R and eccentricity position $\epsilon$ of the drum 11 and an angle $\theta o$ between the eccentricity position $\epsilon$ and the home position of a rotary encoder interlocked to the rotation of the drum 11. Data representative of the above angle $\theta o$ is written to a flash memory or similar memory included in the apparatus and may be used to calculate the previously stated value d also.

Figure 14:
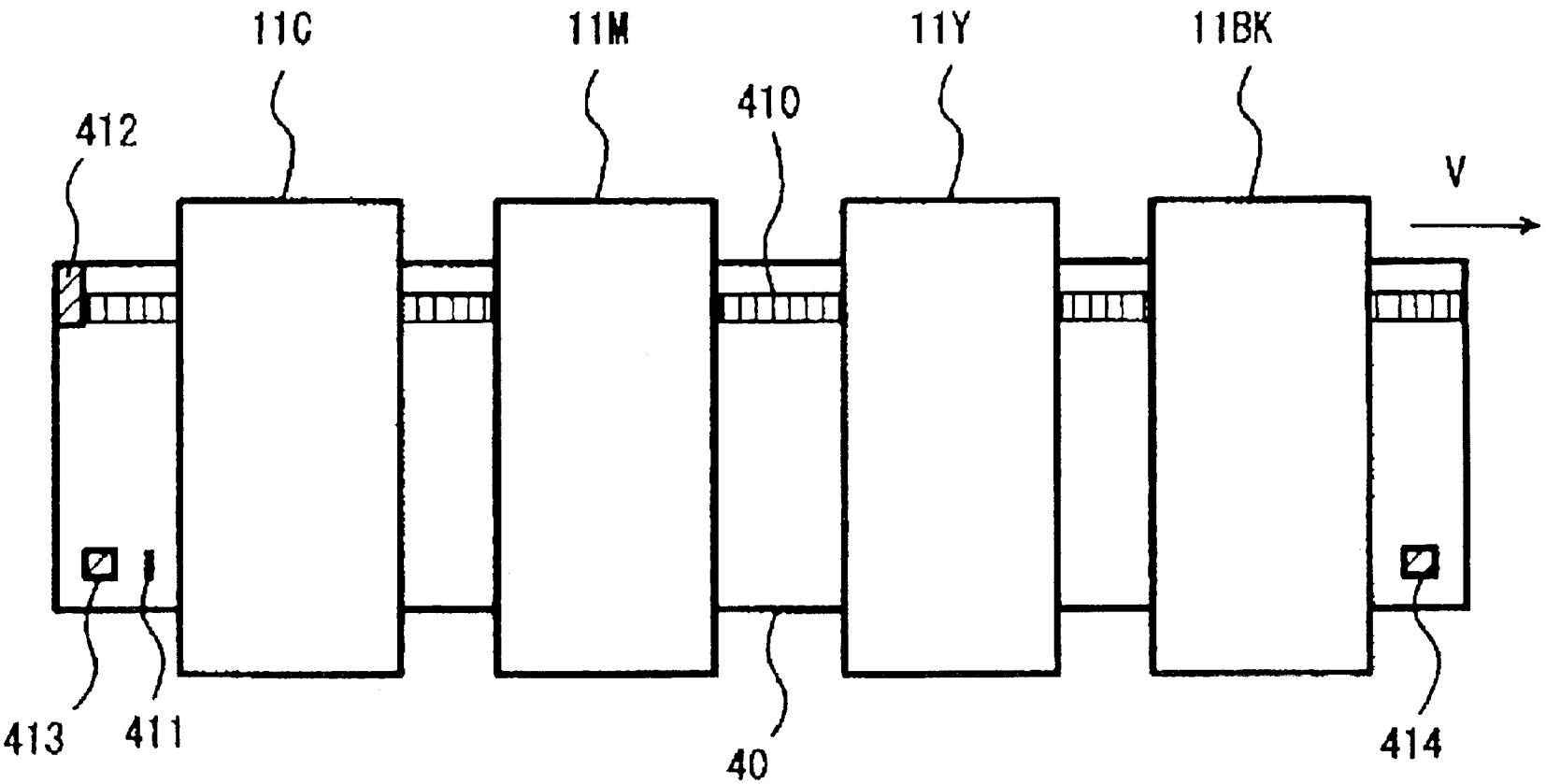
FIG. 14 is a view showing a system for measuring the eccentricity and radius R of each photoconductive drum.
Figure 15A:
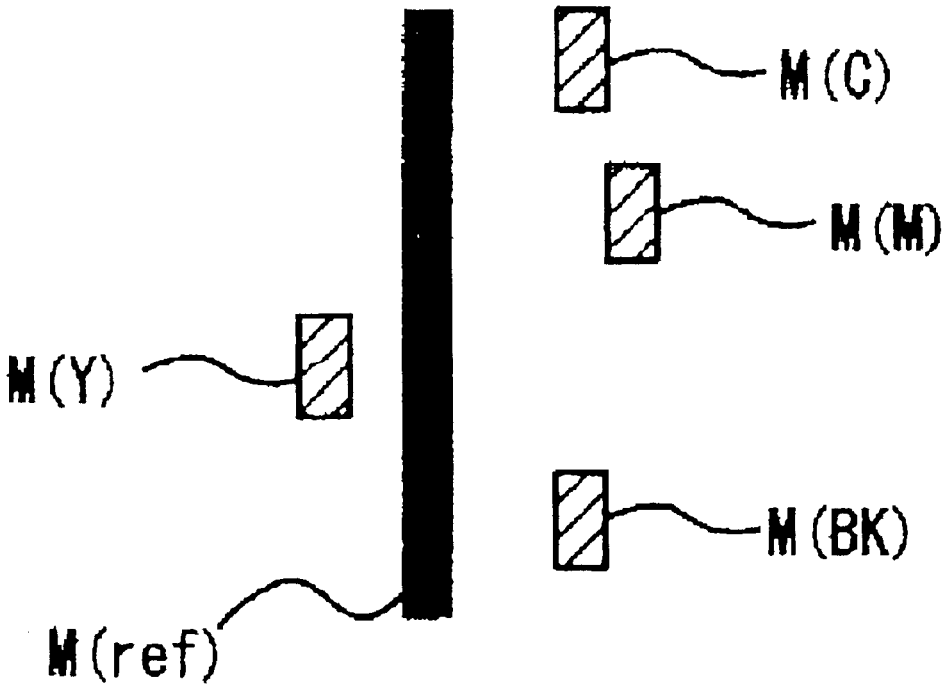
FIGS. 15A and 15B are views showing test marks and a reference mark put on an intermediate image transfer belt.
Figure 15B:
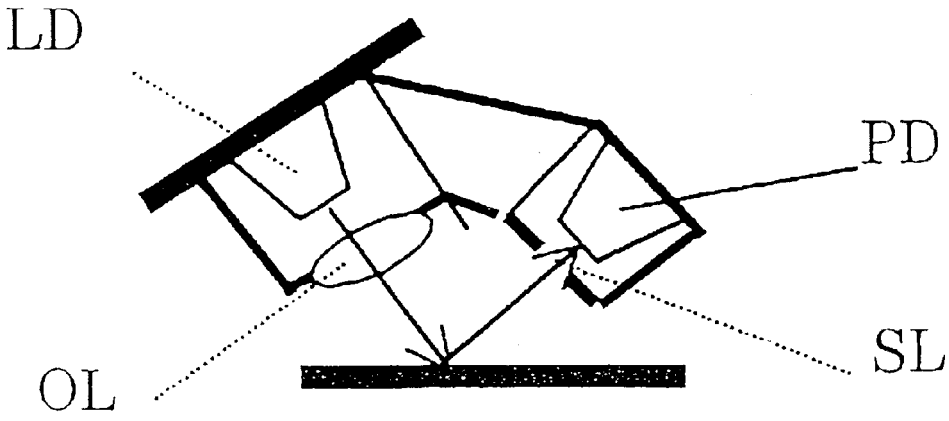

Reference will be made to FIGS. 14, 15A and 15B for describing the above measurement sequence more specifically. The sensor responsive to the reference angular position or home position of rotation angle, rotation angle encoder and sensor (eccentricity sensor) responsive to the displacement of the drum surface are associated with each of the drums 11C through 11BK, although not shown specifically. The belt 40 is driven by a motor not shown. The polygonal mirror, which is driven at constant speed by an exclusive motor, deflects light beams issuing from laser diodes, thereby scanning the drums 11C through 11BK at fixed positions in the main scanning direction.

First, when the power source of the apparatus is turned on, the motor causes the belt 40 to move. If the belt 40 is driven at low speed such that the belt 40 and drum 11 move integrally without any slip, then the drum 11 follows the rotation of the belt 11. One rotation of the drum 11 is sensed on the basis of the output of the sensor responsive to the reference position of rotation angle. The resulting pulses output from a linear encoder 412 are counted to determine the radius of the drum 11. At this instant, the phase of pulse intervals may also be determined to enhance accuracy. Further, by detecting the output of the eccentricity position sensor, an eccentricity position is determined in accordance with the output of the sensor responsive to the reference position of rotation angle and the output of the rotation angle encoder. The amplitude of eccentricity can be detected in terms of the AC amplitude of the output of the eccentricity position sensor. Such measurement is executed with all of the drums 11C through 11BK. The resulting data are used to calculate a correction value d=(RO−R) for one rotation ($\theta$=0~2$\pi$) with each drum. The correction values d calculated are written to a memory included in a controller, not shown, as a lookup table.

Subsequently, when an end position sensor 413 senses a reference mark 411 put on the belt 40, main scanning data are written on the drums 11 such that test marks will be transferred to the belt 40 over the reference mark 411, indicating that the drums 11 are located at ideal positions and have an ideal configuration. Assume that the timing phase of main scanning of the polygonal mirror is not coincident with the timing phase of subscanning derived from the movement of the belt 40 due to, e.g., disturbance. Then, the timing for generating image data in the main scanning direction is determined on the basis of pulses output from the linear encoder 412 responsive to timing marks 410 put on the belt 40. At this instant, the above timing is not always coincident with the main scanning timing of the polygonal mirror. When the main scanning timing of the polygonal mirror is not reached when the timing for generating test marks, test marks are recorded at the main scanning timing of the polygonal mirror.

As shown in FIG. 15A, differences between the test marks M(C), M(M), M(Y) and M(BK) formed on the belt 40 and the reference mark 411 (M(ref)) are determined. Subsequently, by correcting d ascribable to eccentricity and irregularity in radius and the above error are corrected drum by drum to thereby correct the mounting error of the drum 11. In this manner, correction data relating to the mounting error of the drum 11 and correction data d relating to the eccentricity and radius irregularity of the drum 11 are produced. Such data are used to shift the exposure position on the drum 11 or the timing for generating image data, as stated earlier, for thereby freeing an image from color shift and distortion.

As shown in FIG. 15B, a reference position error sensor 414 is implemented as four mark sensing units each comprising a light-emitting portion made up of a light-emitting device LD and an object lens OL and a light-sensitive portion made up of a slit SL and a light-sensitive device PD. The four mark sensing units are arranged in the direction perpendicular to the direction of belt movement so as to sense the four test marks M(C) through M(BK).

Generally, the drums 11 are replaced even after the apparatus has been delivered to the user's station. Therefore, the radius and eccentricity of each drum 11 may be automatically measured within the apparatus or measured in the factory beforehand and then put on a barcode label, in which case the barcode label will be adhered to a preselected position on the drum 11; a barcode reader will be installed in the apparatus for reading the barcode label. Alternatively, sensors responsive to the positions of the barcode labels may be disposed in the apparatus. Further, marks indicative of the reference position of the drums 11 may be put on the drums 11 and sensed by sensors disposed in the apparatus. When measurement is effected in the factory beforehand, additional steps of measuring the radius and eccentricity of each drum 11 and then adhering the barcode labels are executed.

To measure the radius of each drum 11 within the apparatus, while the drum driveline is held in a halt, the belt driveline drives the belt 40 to thereby determine how much the drum 11 rotates for a preselected distance of belt movement. That is, the drum 11 is rotating. To enhance accurate measurement, the preselected distance of belt movement should preferably be coincident with one rotation of the drum 11.

The distance of belt movement is measured by use of a rotary encoder directly connected to the drive roller of the belt driveline or a linear encoder responsive to timing marks put on the edge portion of the belt 40. To measure the rotation angle of each drum 11, a rotation angle encoder is directly connected to the shaft of the drum 11. The rotation angle encoder may be used to accurately control the rotation of the drum 11. Even the rotary encoder or the linear encoder directly connected to the belt drive roller does not increase cost because it can be used to accurately drive the belt 40 at constant speed.

In the case where the drum 11 is driven via gears and an encoder is connected to the output shaft of a motor for controlling the motor, a sensor that outputs a single pulse for a single rotation is connected to the drum drive shaft. In this case, measurement is based on the number of pulses output from the linear encoder or the rotary encoder assigned to the belt driveline.

The second image transfer body to which an image is transferred from the belt 40 may be implemented as an intermediate image transfer drum, in which case the image will be transferred from the image transfer drum to a sheet. This configuration can make the previously stated influence coefficients $\kappa_1$ and $\kappa_2$ at the image transfer positions equal to each other.

As stated above, in the illustrative embodiment, even when the moving speed of the belt 40 periodically varies or each drum 11 has eccentricity and irregularity in radius, the expansion or the contraction of a pixel transferred to the sheet 2 can be reduced. Also, the shift of a pixel ascribable to the shift of the center of the nip for image transfer is reduced. Further, the width of the nip is maintained constant to thereby further reduce color shifts and expansion and contraction.

The expansion or the contraction of a pixel on the sheet 2 can also be reduced even when a preselected speed difference or relative speed is provided between the drum 11 and the belt 40 in order to obviate hollow characters. This is also true even when the image transfer process conditions other than the nip widths $W_1$ and $W_2$ and relative speeds are different from the first image transfer position to the second image transfer position. Moreover, when the peripheral speed of the drum 11 is higher than the moving speed of the sheet 2 and when an image transfer process of the kind extending the end of a pixel, the extension can be corrected without regard to the sign of the relative speed at the image transfer position.

Figure 16:
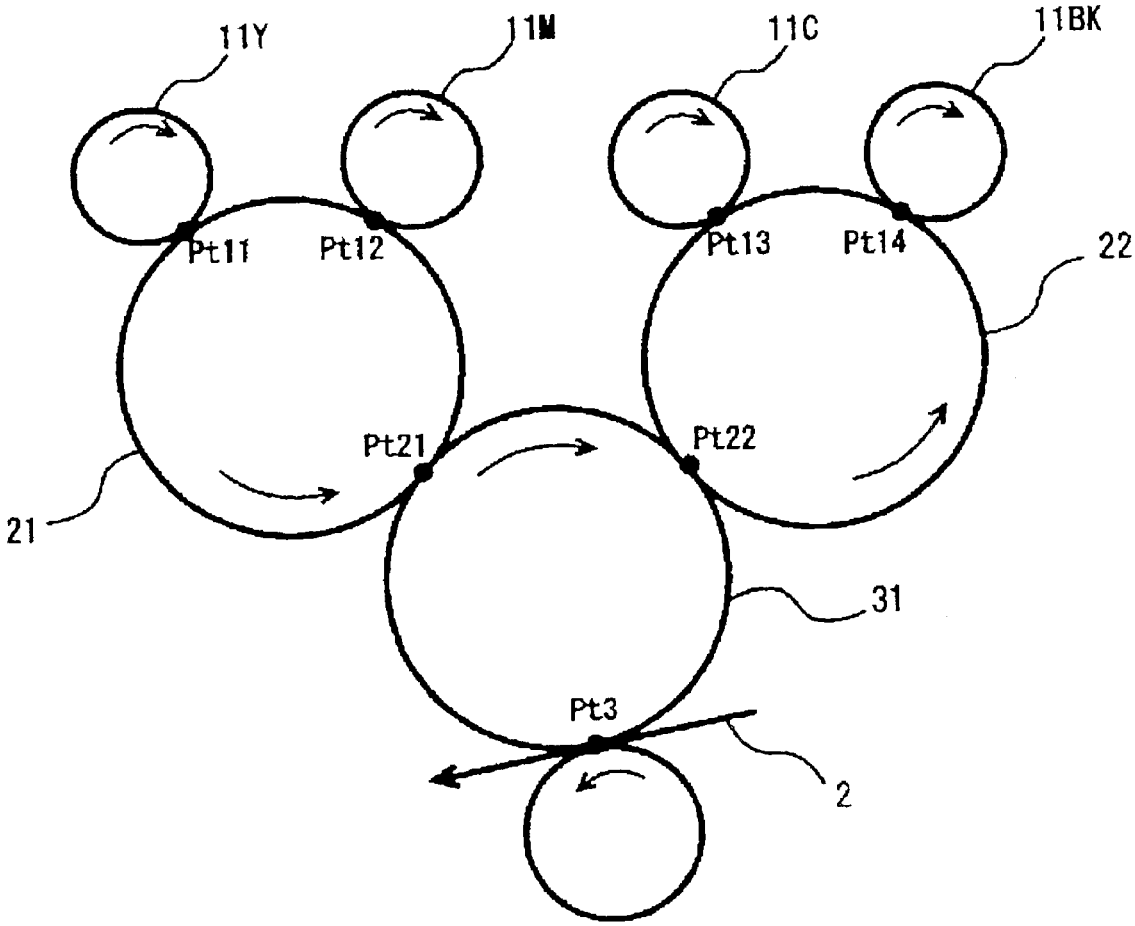
FIG. 16 is a fragmentary view showing an alternative embodiment of the present invention.

Referring to FIG. 16, an alternative embodiment of the present invention will be described. Briefly, the illustrative embodiment uses two intermediate image transfer drums in place of the intermediate image transfer belt 40 and transfers toner images formed on the drums 11M through 11BK to the sheet 2 by way of two consecutive image transferring steps.

As shown in FIG. 16, two intermediate image transfer drums or first image transfer bodies 21 and 22 each are assigned to two of the four drums 11C through 11BK. A magenta and a yellow toner image formed on the drums 11M and 11Y, respectively, are transferred to the intermediate image transfer drum 21 one above the other at first image transfer positions Pt11 and Pt12, respectively. Likewise, a cyan and a black toner image formed on the drums 11C and 11BK respectively, are transferred to the intermediate image transfer drum 22 one above the other at first image transfer positions Pt13 and Pt14, respectively. An intermediate image transfer body or second intermediate image transfer body 31 faces the two intermediate image transfer drums 21 and 22 and plays the role of a rotary, electric field applying body. The composite toner images formed on the intermediate image transfer drums 21 and 22 are sequentially transferred to the intermediate image transfer drum 31 on above the other at second image transfer positions Pt21 and Pt22, respectively. The resulting color image is transferred from the drum 31 to the sheet 2.

Although the illustrative embodiment is similar to Laid-Open Publication No. 2001-265081 mentioned earlier as to basic configuration, the above document does not address to irregularity in radius or the eccentricity of the four drums 11C through and 11BK and three drums 21, 22 and 23. Even if the drums or first image transfer drums 21 and 22 have eccentricity and irregularity in radius, the relation of $\delta V=\delta U$ stated in the previous embodiment holds so long as the drums 21 and 22 rotate at the same angular velocity. However, the intermediate image transfer drums 21 through 23 each are made up of a metallic core and a low-resistance elastic layer formed of rubber, typically conductive silicone rubber, so that the nip width varies at each image transfer position. More specifically, the nip width varies at the first image transfer position between any one of the drums 11 and the intermediate image transfer drum 21 or 22 associated therewith and the second image transfer position between each of the drums 21 and 22 and the intermediate image transfer drum 31 due to the irregularity in radius and eccentricity of the drums. As a result, a pixel is expanded or contracted.

In the illustrative embodiment, to correct the irregularity in radius of the drums 11 and intermediate image transfer drum 31 for thereby implementing mean peripheral speeds that satisfy the Eq. (33), the angular velocities of the drums 11 and 31 are controlled. With this control, it is possible to reduce the expansion or the contraction of a pixel transferred to the drum 31. Although a pixel is expanded or contracted at each image transfer position due to the variation of the nip width, expansion or contraction can be further reduced if a mean nip width $W_2$ satisfying the Eq. (35) is selected.

The prerequisite with the illustrative embodiment is that any one of the drums and intermediate image transfer drums whose radius should be corrected be controllable independently of the others. The radius of each drum or intermediate image transfer drum may be measured in the factory and written to a flash memory included in the image forming apparatus. Again, the barcode label and barcode reader scheme stated earlier is necessary. Alternatively, encoders may be mounted to the shafts of the drums or the intermediate image transfer drums whose radiuses should be corrected, in which case pulses output from the encoders when, e.g., the drum or second image transfer body 31 makes one rotation will be counted. In this case, the intermediate image transfer drums should rotate by following the rotation of the intermediate image transfer drum 31.

In the illustrative embodiment, to reduce the influence of eccentricity, the intermediate image transfer drum 31 is provided with the same radius and angular velocity as the drums 11, so that the drums 31 and 11 are matched to each other in eccentricity phase at positions where the same pixel is formed. In this configuration, even when the intermediate image transfer drums or first image transfer bodies 21 and 22 have eccentricity, the variation of speed difference or relative speed to occur when the same pixel is formed due to the eccentricity of the drums 11 and 31 can be reduced. This successfully reduces the expansion or the contraction of a pixel formed at the image transfer positions Pt11 through Pt14, Pt21 and Pt22. The eccentricity of each drum is measured in the factory. Each drum should only be mounted to the apparatus in accordance with a mark indicative of an eccentricity phase and positioned in the apparatus. Data representative of measured eccentricity may be attached to each drum that will be replaced after delivery.

The illustrative embodiment, however, cannot reduce the influence of irregularity in radius and that of eccentricity at the same time. Therefore, the illustrative embodiment may be practiced with more effective one of the above influences. Data representative of the eccentricity phase or the irregularity in radius of the drums 11 and intermediate image transfer drum 31 may be measured on the production line beforehand, so that their eccentricity phases can be matched at the time of assembly. Alternatively, the angular velocity of the drums 11 and that of the drum 31 may be changed.

In the illustrative embodiment, two of the drums 11 are held in contact with one of the two intermediate image transfer drums 21 and 22, as stated above. Therefore, the mean peripheral speed of each drum 11 and that of the intermediate image transfer drum 31 are equalized as in the illustrative embodiment. In the illustrative embodiment, a period of time necessary for each of the intermediate image transfer drums 21 and 22 to move from the first image transfer position Pt1 to the second image transfer position Pt2 is selected to be a natural number multiple of the speed variation to occur on the circumference of the drum 21 or 22. For example, periods of time necessary for the circumference of the intermediate image transfer drum 21 to move from each of the first and second image transfer positions Pt11 and Pt12 to the second image transfer position Pt21 each are selected to be a natural number multiple of the period of speed variation to occur on the circumference of the drum 21. This is also true with the other intermediate image transfer drum 22 except that the above period of time relates to the first image transfer positions Pt13 and Pt14 and second image transfer position Pt22. This configuration reduces the expansion or the contraction of a pixel ascribable to the period speed variation to occur on the circumference of the drums 21 and 22.

When the drums 21 and 22 satisfy the above conditions, a period of time necessary for each of the intermediate image transfer drums 21 and 22 to move between the first image transfer positions is also a natural number multiple of the period of the speed variation mentioned above. Consequently, color shifts on the intermediate image transfer drums 21 and 22 are also reduced.

The periodic speed variation to occur on the circumferences of the drums 21 and 22 are ascribable to, e.g., the eccentricity of gears included in a driveline, an error in the thickness of a timing belt, and the eccentricity of pulleys. Another possible cause of the periodic speed variation is variations transferred from the drums 11 and intermediate image transfer drum 31.

The intermediate image transfer drum or second image transfer body 31 contacts the intermediate image transfer drums 21 and 22 at the second image transfer positions Pt21 and Pt22 and contacts the sheet 2 at the third image transfer position Pt3, as stated earlier. In the illustrative embodiment, the moving speed of the sheet 2, as measured at the image transfer position Pt3, is selected to be equal to the mean peripheral speed of the intermediate image transfer drums 21 and 22. At this instant, because a pixel formed on the sheet 2 differs in length from an exposed pixel, the difference is corrected by varying the rate and timing of generation of image data. Periods of time necessary for the circumference of the drum 31 to move from the second image transfer positions Pt21 and Pt22 to the image transfer position Pt3 each are selected to be a natural number multiple of the period of speed variation to occur on the circumference of the drum 31. This is successful to reduce the expansion or the contraction of a pixel on the drum 31 ascribable to the periodic speed variation.

When the intermediate image transfer drum 31 satisfies the above conditions, a period of time necessary for drum 31 to move between the second image transfer positions is also a natural number multiple of the period of the speed variation mentioned above. Consequently, color shifts on the intermediate image transfer drums 21 and 22 are also reduced.

The periodic speed variation to occur on the circumferences of the intermediate image transfer drum 31 is ascribable to, e.g., the eccentricity of gears included in a driveline, an error in the thickness of a timing belt, and the eccentricity of pulleys. Another possible cause of the periodic speed variation is variations transferred from the drums 21 and 22, sheet 2 and drums 11.

The measure against expansion and contraction ascribable to the periodic speed variation of the drum 31 is similarly applicable to the case wherein an image is transferred from an intermediate image transfer belt to a sheet or third image transfer body via an intermediate image transfer drum or second image transfer body.

In the actual apparatus configuration, a driveline assigned to, e.g., the intermediate image transfer drums is so configured as to satisfy the conditions described above that relate to a period of time. For example, when a single motor or drive source drives photoconductive drums, intermediate image transfer drums or image transfer rollers via a transmission mechanism including gears, a timing belt and pulleys, periodic speed variation is apt to occur on each driven member due to the variation of load acting on the transmission mechanism or the motor. In such a case, the transmission mechanism or the radius or the image transfer position of the drums or that of each image transfer roller should only be so configured as to satisfy the above conditions.

Another specific measure against expansion and contraction available with the illustrative embodiment will be described hereinafter. In the configuration shown in FIG. 16, a preselected speed difference is provided between the two members contacting each other at each of the image transfer positions, as the case may be. In this configuration, assume that the speed difference or the nip width at each of the second image transfer positions Pt21 and Pt22 is shifted from the condition that cancels expansion and contraction. Then, it is possible to cancel expansion and contraction by selecting the speed Vp of the sheet at the third image transfer position Pt3 or the nip width W at each image transfer position in accordance with the influence coefficients, peripheral speed of the drums 11, peripheral speed of the intermediate image transfer drums 21 and 22, and peripheral speed of the intermediate image transfer drum 31. The speed Vp of the sheet 2 and nip width W can be obtained if the analysis of expansion and contraction described in the previous embodiment is applied to the second image transfer positions Pt21 and Pt22 and third image transfer position Pt3. Likewise, this scheme is practicable even when an image is transferred from an intermediate image transfer belt or second image transfer body to a sheet by way of an intermediate image transfer drum or third image transfer body.

Hereinafter will be described a specific measure against expansion and contraction particular to an electrophotographic process different in characteristic from the process described above. As for the expansion or the contraction of a pixel at any one of the image transfer positions Pt11 through Pt14 between the drums 11 and the intermediate image transfer drums 21 and 22 or the image transfer positions Pt1 between the drums 11 and the belt 40, a relation to be described hereinafter holds in some image transfer process. The foregoing description has concentrated on an image transfer process in which the expansion or the contraction $\delta I$ of a pixel is equal to $(W_1+Iw)\cdot\Delta V/Vd$ (contraction when V is greater than 0).

In the nip width $W_1$ at each first image transfer position, a transferred pixel is expanded at its edge, i.e., at the leading edge when the speed of the drums 11 is high or at the trailing edge when it is low. The amount of expansion $\delta I_\epsilon$ is expressed as:

$$\delta I_E = W_1 \cdot |\Delta V|/Vd \qquad \text{Eq. (53)}$$

where $\Delta V$ denotes a difference between the peripheral speed Vd of each drum 11 and that of each intermediate image transfer drum.

Assume that the amount of expansion or contraction when a basic pixel on the drum 11 is transferred to a width visible from the intermediate image transfer drum is $\delta I_M$. Then, the expansion or contraction $\delta I_M$ is expressed as:

$$\delta I_M = Iw \cdot \Delta V/Vd \qquad \text{Eq. (54)}$$

Therefore, assuming that the total expansion or contraction at the first image transfer position is $\delta I$, then there holds:

$$\begin{aligned} \delta I &= \delta I_M - \delta I_E \qquad \text{Eq. (55)} \\ &= Iw \cdot \Delta V / Vd - W_1 \cdot |\Delta V| / Vd \end{aligned}$$

Considering the fact that the expansion of the leading edge or the trailing edge of a pixel varies due to the influence of, e.g., a lubricant, an influence coefficient $\kappa_E$ is used. Also, the ratio in which the basic pixel on the drum 11 is transferred to the width visible from the intermediate image transfer drum, i.e., an influence coefficient $\kappa_M$ is used. The following equation including such influence coefficients holds:

$$\delta I = \delta I_M - \delta I_E \qquad \text{Eq. (56)}$$
$$= \kappa_M \cdot Iw \cdot \Delta V / Vd - \kappa_E \cdot W_1 \cdot |\Delta V| / Vd$$

Assume that an exposed pixel Ie for a unit period of time is Roωo when the angular speed of the drum 11 has the constant value ωo and when the drum radius is Ro. Then, when the drum radius is Ro+ΔRo, an exposed image I=(Ro+ΔRo) ωo=Ie+ΔRoωo is expanded by ΔRoωo for the unit period of time. Assuming that the peripheral speed of the intermediate image transfer drum is Vb=Roωo, then a speed difference of ΔV=Roωo occurs at the image transfer position. It follows that when the influence coefficient is 1, the pixel is contracted by δI derived from $$\delta I = Iw \cdot \Delta V / Vd - W_1 \cdot |\Delta V| / Vd:$$

$$\delta I = (Ie + \Delta Ro\omega o)\, \Delta Ro / (Ro + \Delta Ro) - W_1 \cdot |\Delta Ro| / (Ro + \Delta Ro) \qquad \text{Eq. (57)}$$

Therefore, when $W_1$ is zero, the pixel for a unit period of time is contracted by ΔRoωo. In the condition wherein the nip width can be considered to be zero, a formed pixel does not vary despite the irregularity in drum radius when the drum 11 is rotating at a constant angular velocity. This also applies to eccentricity:

$$\delta I = -W_1 \cdot |\Delta Ro| / (Ro + \Delta Ro) + \Delta Ro\omega o \qquad \text{Eq. (58)}$$

The first member of the Eq. (58) indicates that a contraction Ce=$-W_1 \cdot |\Delta Ro|/(Ro+\Delta Ro)$ occurs when the influence of the nip width is not negligible.

When the speed difference or relative speed at the first image transfer position is reduced, the following advantage is achievable. Assuming that the peripheral speed Vb of the intermediate image transfer drums 21 and 22 is Roωo, when the radius of the drum 11 becomes Ro+ΔRo, the rotation speed of the drum 11 is varied such that the speed difference or relative speed at the first image transfer position becomes zero.

The angular velocity ϵ of the drum 11 is derived from (Ro+ΔRo)ϵ=Vb=Roωo, as follows:

$$\omega = \{Ro/(Ro + \Delta Ro)\}\omega o \qquad \text{Eq. (59)}$$

The exposed unit Ie for a unit period of time is produced by (Ro+ΔRo) ϵ=Roωo. That is, the exposed image is not expanded. Because the speed difference ΔV at the first image transfer position is zero, δI is also zero. In this manner, when the speed difference or relative speed is small, there can be formed a high-quality image with a minimum of expansion or contraction ascribable to the influence of the nip width $W_1$.

By contrast, when a speed difference or relative speed occurs at the first image transfer position, a pixel is expanded due to the influence of the nip width $W_1$, i.e., the eccentricity of the drum 11 and the variation of the peripheral speed of the intermediate image transfer drum ascribable to the eccentricity of the drive roller.

Assume that the speed difference ΔVh is provided at the first image transfer position for obviating hollow characters. Then, assuming that the drum 11 has the constant angular velocity ωo and radius Ro and that an exposed pixel Ie for a unit period of time is Roωo, then an exposed pixel I for a unit period of time when the drum radius is Ro+ΔRo is expanded by Roωo for the unit period of time. Because the peripheral speed of the drums 21 and 22 or the moving speed of the belt 40 is Vb=Roωo−ΔVh and because the speed difference ΔV=Roωo+ΔVh occurs at the first image transfer position, the exposed image Roωo for the unit period of time is contracted by δI=Iw·ΔV/Vd−$W_1$·|ΔV|/Vd. This contraction is expressed as:

$$\delta I = (\Delta Ro\omega o + \Delta Vh) - W_1 \cdot |\Delta Ro\omega o + \Delta Vh| / \{\omega o(Ro + \Delta Ro)\} \qquad \text{Eq. (60)}$$

When the nip width $W_1$ is zero, the pixel is contracted by Roωo+ΔVh, i.e., an error ΔVh corresponding to the speed difference occurs. In the condition wherein the nip width $W_1$ and peripheral speed both are zero, a formed image does not vary despite irregularity in drum radius when the drum 11 is rotating at a constant angular velocity. However, when the speed difference ΔVh is constant, the entire image is contracted (magnification error). This also applies to eccentricity.

When the nip width $W_1$ and speed difference are not zero and have influence, an error (contraction) Ce occurs:

$$Ce = \Delta Vh - W_1 |\Delta Ro\omega o + \Delta Vh| / \{\omega o(Ro + \Delta Ro)\} \qquad \text{Eq. (61)}$$

When the variation of the peripheral speed of the drums 21 and 22 or that of the moving speed of the belt 40 is δV, i.e., when such a speed varies due to the measure against hollow characters, an error E occurs:

$$E = (\Delta Vh + \delta V) - W_1 \cdot |\Delta Ro\omega o + \Delta Vh + \delta V| / \{\omega o(Ro + \Delta Ro)\} \qquad \text{Eq. (62)}$$

The pixel Ie=Roωo exposed for a unit period of time appears on the intermediate image transfer drum 21 or 22 or the belt 40 as a pixel $IW_1$:

$$Iw_1 = Ie - E \qquad \text{Eq. (63)}$$
$$= Ro\omega o - (\Delta Vh + \delta V) + W_1 \cdot |\Delta Ro\omega o + \Delta Vh + \delta V| / \{\omega o(Ro + \Delta Ro)\}$$

The unit pixel Ie=Roωo on the intermediate image transfer drum or second image transfer body 31 or the sheet 2 is contracted by an amount $\delta I_2$:

$$\delta I_2 = Ie \cdot \Delta V_2 / Vt_1 - W_2 \cdot |\Delta V_2| / Vt_1 \qquad \text{Eq. (64)}$$

where $W_2$ denotes the nip width at the second image transfer position, ΔV2 denotes the speed difference or relative speed (=$Vt_1 - V_2$=Vb−$V_2$) at the second image transfer position, $Vt_1$ denotes the linear velocity (=Vb) of the drum 21 or 22 or that of the belt 40, and $V_2$ denotes the linear velocity of the intermediate image transfer drum 31 or that of the sheet 2.

Further, the contraction I2 may be produced by:

$$\delta I_2 = Ie \cdot \Delta V_2 / Vt_1 - W_2 \cdot |\Delta V_2| / Vt_1 \qquad \text{Eq. (65)}$$
$$= Ie \cdot \Delta V_2 / Vb - W_2 |\Delta V_2| / Vb$$
$$= [Ro\omega o] \cdot (\delta - \Delta Vh - \delta U) / (\omega o Ro - \Delta Vh - \delta U) - W_2 \cdot |\delta - \Delta Vh - \delta U| / (\omega o Ro - \Delta Vh - \delta U)$$

Because the time when the same pixel is formed is different, it is assumed that δU is the variation of the peripheral speed of the drum 21 or 22 at the second image transfer position Pt21 or Pt22 or the variation of the speed of the belt 40, and that δV is the variation of the peripheral speed of the drum 21 or 22 at corresponding one of the first image transfer position Pt 11 through Pt14 or the variation of the speed of the belt 40 at the first image transfer position Pt1.

The total contraction E2 is produced by:

$$\begin{aligned} E2 &= E + \delta I_2 \qquad \text{Eq. (66)} \\ &= (\Delta Vh + \delta V) - W_1 \cdot |\Delta Ro\omega o + \Delta Vh + \delta V| / \{\omega o(Ro + \Delta Ro)\} + \\ &\quad [Ro\omega o] \cdot (\delta - \Delta Vh - \delta U) / (\omega oRo - \Delta Vh - \delta U) - \\ &\quad W_2 \cdot |\delta - \Delta Vh - \delta U| / (\omega oRo - \Delta Vh - \delta U) \\ &\approx (\Delta Vh + \delta V) - W_1 \cdot |\Delta Ro\omega o + \Delta Vh + \delta V)| / \{\omega o(Ro + \Delta Ro)\} + \\ &\quad (\delta - \Delta Vh - \delta U) - W_2 \cdot |\delta - \Delta Vh - \delta U| / (\omega oRo - \Delta Vh - \delta U) \end{aligned}$$

A condition close to E2=0 is not available unless at least δV=δU holds. By reducing the influence of ΔRo, it is possible to reduce the influence of the nip width at the first image transfer position.

In an electrophotographic process of the type causing hollow characters to appear little, even when Vh is zero, at least the expansion or contraction of δV=δU holds in relation to the variation δV of the linear velocity of the intermediate image transfer drum or that of the belt V 40 or the irregularity in radius and eccentricity of the drum 11. This, coupled with the arrangement for obviating the influence of ΔRo, causes the following contraction E2 of an exposed pixel ωoRo for a unit period of time to occur:

$$E2 = -W_1 \cdot |\delta U| / \{\omega oRo\} - W_2 \cdot |\delta - \delta U| / (\omega oRo - \delta U) + \delta \qquad \text{Eq. (67)}$$

The contraction E2 is reduced when δ is zero because δU varies. That is, the contraction E2 cannot be reduced to zero. In the process that obviates hollow characters when ΔVh is zero, δV=δU holds while the influence of ΔRo is removed. If δ is zero, then expansion and contraction can be reduced.

An image transfer process that obviates hollow characters by using ΔVh≠0 will be described hereinafter. When δV=δU holds and when the influence of ΔRo is removed, the contraction E2 of the exposed image ωoRo is produced by:

$$E2 = -W_1 \cdot |\Delta Vh + \delta V| / \{\omega oRo\} - W_2 \cdot |\delta - \Delta Vh - \delta V| / (\omega oRo - \Delta Vh - \delta V) + \delta \qquad \text{Eq. (68)}$$

Because δV varies, it cannot be corrected. Therefore, when δV is removed, the contraction E2 is expressed as:

$$E2 = -W_1 \cdot |\Delta Vh| / \{\omega oRo\} - W_2 \cdot |\delta - \Delta Vh| / (\omega oRo - \Delta Vh) + \delta \qquad \text{Eq. (69)}$$

Because ωoRo>>ΔVh holds, the contraction E2 is rewritten as:

$$E2 = -W_1 \cdot |\Delta Vh| / \{\omega oRo\} - W_2 \cdot |\delta - \Delta Vh| / (\omega oRo) + \delta \qquad \text{Eq. (70)}$$

To bring the contraction E2 close to zero, δ should be greater than zero. The contraction E2 is determined in each of three different cases, as will be described hereinafter.

(i) In the case of δ>ΔVh>0, the condition E2 becomes zero under the following condition:

$$E2 = -W_1 \cdot \Delta Vh / \{\omega oRo\} - W_2 \cdot (\delta - \Delta Vh) / (\omega oRo) + \delta = 0$$

$$-W_1 \cdot \Delta Vh - W_2 \cdot (\delta - \Delta Vh) + \delta\omega oRo = -W_1 \cdot \Delta Vh + W_2 \Delta Vh + \delta(\omega oRo - W_2) = 0$$

$$\delta = (W_1 - W_2) \cdot \Delta Vh / (\omega oRo - W_2) \qquad \text{Eq. (71)}$$

When the nip width $W_1$ at the first image transfer position is greater than the nip width $W_2$ at the second image transfer position and selected to satisfy the Eq. (71), the expansion or the contraction of the exposed image ωoRo for a unit period of time is minimized. Because expansion and contraction for a unit period of time has been discussed above, the Eq. (71) includes an equation with a different dimension in its denominator.

(ii) In the case of 0<δ<ΔVh, the contraction E2 becomes zero in the following condition:

$$E2 = -W_1 \cdot \Delta Vh / \{\omega oRo\} + W_2 \cdot (\delta - \Delta Vh) / (\omega oRo) + \delta = 0 - (W_1 + W_2) \cdot \Delta Vh + \delta(\omega oRo + W_2) = 0$$

$$\delta = (W_1 + W_2) \Delta Vh / (\omega oRo + W_2) \qquad \text{Eq. (72)}$$

(iii) In the case of δ>0>ΔVh, the contraction E2 becomes zero in the following condition:

$$E2 = W_1 \cdot \Delta Vh / \{\omega oRo\} - W_2 \cdot (\delta - \Delta Vh) / (\omega oRo) + \delta = 0$$

$$\delta = -(W_1 + W_2) \Delta Vh / (\omega oRo - W_2) \qquad \text{Eq. (73)}$$

By the above equations, δ is determined and allows the expansion or the contraction of a pixel to be corrected. The nip widths $W_1$ and $W_2$ and speed differences ΔVh and δ matching with the above cases (i) through (iii) are selected such that δ is zero when the reference peripheral speed of the drum 11 is ωoRo.

Now, the influence coefficients $\kappa_E$ and $\kappa_M$ will also be taken into account. The image transfer process differs from the first image transfer positions where the drums 11 and intermediate image transfer drums 21 and 22 or the belt 40 face each other to the second image transfer position where the drums 21 and 22 and intermediate image transfer drum 21 or the belt 40 and sheet 2 face each other. Therefore, the width of expansion or that of expansion and contraction varies for a given nip and a given speed difference. In addition, the width of expansion or that of expansion and contraction is influenced by the image transfer process as well. Assume that the influence coefficients are $\kappa_{E1}$ and $\kappa_{M1}$ at the first image transfer positions or $\kappa_{E2}$ and $\kappa_{M2}$ at the second image transfer positions. Then, a contraction $\delta_{1\kappa}$ at the first image transfer positions is expressed as:

$$\begin{aligned} \delta_{1\kappa} &= \kappa_{M1} \cdot Iw \cdot \Delta V / Vd - \kappa_{E1} \cdot W_1 \cdot | \\ &\Delta V| / Vd = \kappa_{M1} \cdot (Ro + \Delta Ro) \cdot \omega o \cdot (\Delta Ro\omega o + \\ &\Delta Vh + \delta V) / \{\omega o(Ro + \Delta Ro)\} - \kappa_{E1} \cdot W_1 \cdot | \\ &\Delta Ro\omega o + \Delta Vh + \delta V| / \{\omega o(Ro + \Delta Ro)\} = \\ &\kappa_{M1} \cdot (\Delta Ro\omega o + \Delta Vh + \delta V) - \kappa_{E1} \cdot W_1 \cdot | \\ &\Delta Ro\omega o + \Delta Vh + \delta V| / \{\omega o(Ro + \Delta Ro)\} \qquad \text{Eq. (74)} \end{aligned}$$

It follows that an error (contraction) $E_\kappa$ occurs due to the influence of the nip width and speed difference:

$$E_\kappa = (\kappa_{M1} - 1) \cdot \Delta Ro\omega o + \kappa_{M1} \cdot (\Delta Vh + \delta V) - \kappa_{E1} \cdot W_1 \cdot |\Delta Ro\omega o + \Delta Vh + \delta V| / \{\omega o(Ro + \Delta Ro)\} \qquad \text{Eq. (75)}$$

A condition wherein $\kappa_{M1} = \kappa_{E1} = 1$ holds has been discussed above.

The function of correcting expansion or contraction ascribable to the irregularity in drum radius and represented by the first member of the Eq. (75) is weakened when $\kappa_{M1}$ is not 1. This is also true with eccentricity. More specifically, expansion and contraction can be canceled when $\kappa_{M1}$ is 1, but cannot be canceled when it is not 1. When $\kappa_{M1}$ is not 1, there should be established a condition that makes ΔRoωo zero. The condition of ΔRoωo=0 should only be realized despite the eccentricity and irregularity in radius of the drum 11.

Hereinafter will be described the cancellation of expansion and contraction at the first and second image transfer positions to occur when the speed difference or relative speed is provided. There holds the following equation:

$$\begin{aligned}\delta 2\kappa &= \kappa_{M2}\cdot Ie\cdot \Delta V_2/Vt_1 - \kappa_{E2}\cdot W_2\cdot|\Delta V_2|/Vt_1 \\ &= \kappa_{M2}\cdot Ie\cdot \Delta V_2/Vb - \kappa_{E2}\cdot W_2\cdot|\Delta V_2|/Vb \\ &= \kappa_{M2}\cdot[Ro\omega o]\cdot(\delta-\Delta Vh-\delta U)/(\omega oRo-\Delta Vh-\delta U)- \\ &\quad \kappa_{E2}\cdot W_2\cdot|\delta-\Delta Vh-\delta U|/(\omega oRo-\Delta Vh-\delta U)\end{aligned} \quad \text{Eq. (76)}$$

Because the time when the same pixel is formed is different, it is assumed that δU is the variation of the peripheral speed of the intermediate image transfer drum at the second image transfer position or the variation of the speed of the belt 40, and that δV is the variation of the peripheral speed of the drum at the first image transfer position or the variation of the speed of the belt 40 at the first image transfer position Pt1.

The total contraction E2 is produced by:

$$\begin{aligned}E2 &= E_\kappa + \delta I_2 \\ &= (\kappa_{M1}-1)\cdot\Delta Ro\omega o+\kappa_{M1}\cdot(\Delta Vh+\delta V)- \\ &\quad \kappa_{E1}\cdot W_1\cdot|\Delta Ro\omega o+\Delta Vh+\delta V|/\{\omega o(Ro+\Delta Ro)\}+ \\ &\quad \kappa_{M2}\cdot[Ro\omega o]\cdot(\delta-\Delta Vh-\delta U)/(\omega oRo-\Delta Vh-\delta U)- \\ &\quad \kappa_{E2}\cdot W_2\cdot|\delta-\Delta Vh-\delta U|/(\omega oRo-\Delta Vh-\delta U)\end{aligned} \quad \text{Eq. (77)}$$

If the drums, intermediate image transfer belt and second image transfer position are arranged in the relation unique to the illustrative embodiment, then the condition. δV=δU is satisfied, and therefore the following equation holds:

$$\begin{aligned}E2 &= (\kappa_{M1}-1)\cdot\Delta Ro\omega o+ \\ &\quad \kappa_{M1}\cdot(\Delta Vh+\delta V)- \\ &\quad \kappa_{E1}\cdot W_1\cdot|\Delta Ro\omega o+\Delta Vh+\delta V|/\{ \\ &\quad \omega o(Ro+\Delta Ro)\}+\kappa_{M2}\cdot(\delta- \\ &\quad \Delta Vh-\delta V)-\kappa_{E2}\cdot W_2\cdot| \\ &\quad \delta-\Delta Vh-\delta V|/(\omega oRo-\Delta Vh- \\ &\quad \delta V)\end{aligned} \quad \text{Eq. (78)}$$

where the relation of ωoRo>>ΔVh+δU is taken into consideration.

Further, when the influence of the eccentricity and irregularity in radius of the drum 11 is removed, there holds:

$$\begin{aligned}E2 &= \kappa_{M1}\cdot(\Delta Vh+\delta V)- \\ &\quad \kappa_{E1}\cdot W_1\cdot|\Delta Vh+\delta V|/\{\omega oRo\} \\ &\quad +\kappa_{M2}\cdot(\delta-\Delta Vh-\delta V)-\kappa_{E2}\cdot W_2\cdot| \\ &\quad \delta-\Delta Vh-\delta V|/(\omega oRo-\Delta Vh-\delta V)\end{aligned} \quad \text{Eq. (79)}$$

A specific configuration for reducing E2 when expansion or contraction other than one occurring at the edge of a pixel to zero may be expressed as:

$$\kappa_{M1}\cdot(\Delta Vh+\delta V)+\kappa_{M2}\cdot(\delta-\Delta Vh-\delta V)=0 \quad \text{Eq. (80)}$$

$$\min[\kappa_{E1}\cdot W_1\cdot|\Delta Vh+\delta V|/\{\omega oRo\}+\kappa_{E2}\cdot W_2\cdot|\delta-\Delta Vh-\delta V|/(\omega oRo-\Delta Vh-\delta V)]=\min[\kappa_{E1}\cdot\kappa_{M2}\cdot W_1/\{\kappa_{M1}\omega oRo\}+\kappa_{E2}\cdot W_2\cdot/(\omega oRo-\Delta Vh-\delta V)] \quad \text{Eq. (81)}$$

where min[ ] indicates that the bracketed value is minimum.

Neglecting δV in the Eq. (80) because it varies, there holds:

$$\kappa_{M1}\cdot\Delta Vh=\kappa_{M2}\cdot(\Delta Vh-\delta)$$

$$\delta=(1-\kappa_{M1}/\kappa_{M2})\cdot\Delta Vh \quad \text{Eq. (82)}$$

In the Eq. (81), the variation of the peripheral speed of the drum or that of the speed of the belt 40 is an error. However, assuming δV=0 and taking account of ωoRo>>ΔVh, the following equation holds:

$$\min[\kappa_{E1}\cdot\kappa_{M2}\cdot W_1+\kappa_{M1}\cdot\kappa_{E2}\cdot W_2] \quad \text{Eq. (83)}$$

If the peripheral speed of the intermediate image transfer drum 31 and nip width are so selected as to satisfy the Eqs. (82) and (83), then an image with a minimum of expansion or contraction is achieved. The nip widths $W_1$ and $W_2$ should preferably be small. As the first member of the Eq. (78) indicates, the influence coefficient $\kappa_{M1}$ should preferably be close to 1 in order to reduce the influence of a correction error relating to eccentricity or irregularity in radius. The influence coefficient $\kappa_{M1}$ should also be close to 1 in order to prevent the δ correction value from increasing.

When the influence of the eccentricity and irregularity in radius of the drum 11 is removed, the total contraction E2 is expressed as:

$$E2=\kappa_{M1}\cdot(\Delta Vh+\delta V)-\kappa_{E1}\cdot W_1\cdot|\Delta Vh+\delta V|/\{\omega oRo\}+\kappa_{M2}\cdot(\delta-\Delta Vh-\delta V)-\kappa_{E2}\cdot W_2\cdot|\delta-\Delta Vh-\delta V/(\omega oRo-\Delta Vh-\delta V) \quad \text{Eq. (84)}$$

Considering the relation of ωoRo>>ΔVh+δU and neglecting V, there holds:

$$E2=\kappa_{M1}\cdot\Delta Vh+\kappa_{M2}\cdot(\delta-\Delta Vh)-\kappa_{E1}\cdot W_1|\Delta Vh|/\{\omega oRo\}-\kappa_{E2}\cdot W_2\cdot|\delta-\Delta Vh|/(\omega oRo) \quad \text{Eq. (85)}$$

Assuming that $\kappa_{M1}$ and $\kappa_{M2}$ are substantially close to each other, the total contraction E2 approaches zero if δ is greater than zero. The total contraction E2 is determined in three different cases hereinafter, as follows.

(i) When δ>ΔVh>0 holds, a condition satisfying E2=0 is expressed as:

$$E2=\kappa_{M1}\cdot\Delta Vh+\kappa_{M2}(\delta-\Delta Vh)-\kappa_{E1}\cdot W_1\cdot\Delta Vh/\{\omega oRo\}-\kappa_{E2}\cdot W_2\cdot(\delta-\Delta Vh)/(\omega oRo)=0 \quad \text{Eq. (86)}$$

Paying attention to δ, there holds:

$$\delta=\{(\kappa_{M2}-\kappa_{M1})(\omega oRo)+\kappa_{E1}W_1-\kappa_{E2}\cdot W_2\}\Delta Vh/(\kappa_{M2}\cdot\omega oRo-\kappa_{E2}\cdot W_2) \quad \text{Eq. (87)}$$

By selecting various parameters in matching relation to the above equations, it is possible to minimize the expansion or the contraction of the exposed pixel ωoRo for a unit period of time. Because the foregoing description has concentrated on the expansion and contraction of a pixel for a unit period of time, a member of different dimension is included as in the denominator.

(ii) When 0<δ<ΔVh holds, a condition satisfying E2=0 is expressed as:

$$E2=\kappa_{M1}\cdot\Delta Vh+\kappa_{M2}(\delta-\Delta Vh)-\kappa_{E1}\cdot W_1\cdot\Delta Vh/\{\omega oRo\}+\kappa_{E2}\cdot W_2\cdot(\delta-\Delta Vh)/(\omega oRo)=0 \quad \text{Eq. (88)}$$

Paying attention to δ, there holds:

$$\delta=\{(\kappa_{M2}-\kappa_{M1})(\omega oRo)+\kappa_{E1}\cdot W_1+\kappa_{E2}\cdot W_2\}\cdot\Delta Vh/(\kappa_{M2}\cdot\omega oRo+\kappa_{E2}\cdot W_2) \quad \text{Eq. (89)}$$

(iii) When $\delta>0>\Delta Vh$ holds, a condition satisfying E2=0 is expressed as:

$$E2=\kappa_{M1}\cdot\Delta Vh+\kappa_{M2}(\delta-\Delta Vh)+\kappa_{E1}\cdot W_1\cdot\Delta Vh/\{\omega oRo\}-\kappa_{E2}\cdot W_2\cdot(\delta-\Delta Vh)/(\omega oRo)=0 \quad \text{Eq. (90)}$$

Paying attention to δ, there holds:

$$\delta=\{(\kappa_{M2}-\kappa_{M1})\cdot(\omega oRo)-\kappa_{E1}\cdot W_1-\kappa_{E2}\cdot W_2\}\cdot\Delta Vh/(\kappa_{M2}\cdot\omega oRo-\kappa_{E2}\cdot W_2) \quad \text{Eq. (91)}$$

By the above equations, δ is determined and allows the expansion or the contraction of a pixel to be corrected. The nip widths $W_1$ and $W_2$, speed differences ΔVh and δ and influence coefficients $\kappa_{M1}$, $\kappa_{M2}$, $\kappa_{E1}$ and $\kappa_{E2}$ matching with the above cases (i) through (iii) are selected such that δ is greater than zero when the reference peripheral speed of the drum 11 is ωoRo.

As stated above, the illustrative embodiment reduces the expansion or the contraction of a pixel on the intermediate image transfer drum 31 ascribable to the periodic variation of the peripheral speed of the intermediate drum 21 or 22. There can also be reduced the contraction of a pixel on the sheet 2 ascribable to the period variation of the peripheral speed of the intermediate image transfer drum 31.

Further, when use is made of an image transfer process of the type expanding the edge of a pixel, the expansion of a pixel can be corrected without regard to the sign of a speed difference at the image transfer position. The expansion or the contraction of a pixel on the drum 31 can be reduced without regard to the eccentricity of the intermediate image transfer drum 31 when a speed difference is provided at the image transfer position for obviating hollow characters.

What is claimed is:

1. An image forming apparatus comprising:

a single or a plurality of image carriers;

means for rotating said single or said plurality of image carriers;

image forming means for forming a plurality of images on said single or said plurality of rotating image carriers;

first image transferring means for transferring the images from said single or said plurality of rotating image carriers to a first transfer body driven by a first drive means so as to move through a first image transfer position corresponding to said single image first image transferring means for transferring the images from said single or said plurality of rotating image carriers to a single or a plurality of first image transfer bodies driven by a first drive means so as to move through a first image transfer position corresponding to said single image carrier and said single first image transfer body located where said single first transfer body is adjacent to said single image carrier or through plural first image transfer positions corresponding to said plurality of rotating image carriers and said single first image transfer body or said plurality of first image transfer bodies where said single first image transfer body or said plurality of said first image transfer bodies are adjacent to said plurality of rotating image carriers;

second image transferring means for transferring resulting images from said first single image transfer body or said plurality of said first image transfer bodies to a second transfer body driven by a second drive means to move through a second image transfer position where said second image transfer body is adjacent to said first single image transfer body or through a plurality of second image transfer positions where said second image transfer body is adjacent to said plurality of said first image transfer bodies, wherein said second image transfer body comprises a roller;

third image transferring means for transferring the images from said second image transfer roller to a recording medium being driven by a third drive means to move through a third image transfer position where said recording medium is adjacent to said second image transfer roller;

means for making radiuses and angular velocities of said single or said plurality of image carriers equal to a radius and an angular velocity of said second image transfer roller; and means for making a position on an image carrying surface of each image carrier present where a given pixel is to be formed and a position on a second image transfer surface of said second image transfer roller where said given pixel is to be formed identical in an angle at which an eccentricity angle position has a greatest value.

2. The apparatus as claimed in claim 1, further comprising:

third image transferring means for transferring images from said second image transfer body to a recording medium being driven by a third drive means to move through a third image transfer position where said recording medium is adjacent to said second image transfer body; and means for making a moving speed of the first image transfer surface of said first image transfer body higher than a moving speed of a third image transfer surface of said recording medium.

3. The apparatus as claimed in claim 1, further comprising:

means for making a moving speed of the image carrying surface of said each image carrier present equal to a moving speed of the second image transfer surface of said second image transfer body, and means for making a period of time necessary for a first image transfer surface of said first image transfer body to move from said first image transfer position or said first image transfer positions to said second image transfer position in a direction of movement of said first image transfer surface a natural number multiple of a period of speed variation occurring on said first image transfer surface.

4. The apparatus as claimed in claim 3, wherein the first image transfer surface of said first image transfer body is endless, a same position of said first image transfer surface is moved to one first image transfer position a plurality of times when said single image carrier is present or the same position of said first image transfer surface is moved by the first moving means to a plurality of first image transfer positions when said plurality of image carriers are present, whereby the images are transferred from said single or said plurality of image carriers to said same position of said first image transfer surface of the first image transfer body one above another to form a composite image; and means for making a period of time necessary for the first image transfer surface of said first image transfer body to move in the direction of movement of said first image transfer body from the second image transfer position to the one first image transfer position when said single image carrier is present or to the plurality of first image transfer positions when said plurality of image carriers are present a natural number multiple of the period of speed variation occurring on said first image transfer surface.

5. The apparatus as claimed in claim 1, wherein, when said plurality of image carriers are present, said means for rotating rotates said plurality of image carriers such that mean moving speeds of image carrying surfaces of said plurality image carriers are equal to each other;

wherein nip width for image transfer between said each image carrier present and said first image transfer body at the first image transfer position or at the plural first transfer positions does not vary, said image forming means exposes the image carrying surfaces of said single or said plurality of rotating image carriers in accordance with image data to thereby form latent images by selecting an exposing timing or an exposing position assigned to the image carrying surface of said each image carrier present in accordance with at least either one of eccentricity and irregularity in radius of said each image carrier present and a distance between said image carriers when said plurality of rotating image carriers are present and then develops said latent images for thereby producing corresponding toner images.

6. An image forming apparatus comprising:

a single or a plurality of image carriers;

means for rotating said single or said plurality of image carriers:

image forming means for forming a plurality of images on said single or said plurality of rotating image carriers;

first image transferring means for transferring the images from said single or said plurality of rotating image carriers to a first transfer body driven by a first drive means so as to move through a first image transfer position relative to said single image carrier and through a plurality of first transfer positions relative to said plurality of image carriers, wherein, at each first image transfer position present relative to said single image carrier or said plurality of image carriers, said first image transfer body is adjacent to either said single or said plurality of rotating image carriers;

second image transferring means for transferring the images from said first image transfer body to a second image transfer body driven by a second drive means so as to move through a second image transfer position where said second image transfer body is adjacent to said first image transfer body;

means for making a speed of movement for an image carrying surface of either said single or said plurality of rotating image carriers equal to a speed at which a second image transfer surface of said second image transfer body moves; and means for making a period of time necessary for a first image transfer surface of said first image transfer body to move from each first image transfer position present relative to said single image carrier or said plurality of image carriers to the second image transfer position in a direction of movement of said first image transfer surface a natural number multiple of a period of speed variation occurring on said first image transfer surface.

7. The apparatus as claimed in claim 1, wherein the first image transfer surface of said first image transfer body is endless, a same position of said first image transfer surface is moved by the first moving means to one first image transfer position a plurality of times when said single image carrier is present or the same position of said first image transfer surface is moved by the first moving means to a plurality of first image transfer positions when said plurality of image carriers are present, whereby the images are transferred from said single or said plurality of image carriers to said same position of said first image transfer surface of the first image transfer body one above another to form a composite image; and means for making a period of time necessary for the first image transfer surface of said first image transfer body to move in the direction of movement of said first image transfer body from the second image transfer position to the one first image transfer positions when said single image carrier is present or to the plurality of first image transfer position when said plurality of image carriers are present a natural number multiple of the period of speed variation occurring on said first image transfer surface.

8. The apparatus as claimed in claim 7, further comprising:

third image transferring means for transferring the composite image from said second image transfer body to a third image transfer body being driven by a third drive means to move through a third image transfer position where said third image transfer body is adjacent to said second image transfer body;

means for making a speed at which the first image transfer surface of said first image transfer body moves is equal to a speed at which a third image transfer surface of said third image transfer body moves; and means for making a period of time necessary for the second image transfer surface of said second image transfer body to move from the second image transfer position to the third image transfer position in the direction of movement of said second image transfer body a natural number multiple of a period of speed variation occurring on said second image transfer surface of said second image transfer body.

9. The apparatus as claimed in claim 8, wherein the second image transfer surface of said second image transfer body is endless, a same position of said second image transfer surface of said second image transfer body is moved by the second moving means through the second image transfer position a plurality of times, whereby the composite image is transferred from said first image transfer surface of said first image transfer body to said second image transfer surface of said second image transfer body one above another, and means for making a period of time necessary for the second image transfer surface of said second image transfer body to move from the third image transfer position to the second image transfer position in the direction of movement of said second image transfer body a natural number multiple of the period of speed variation occurring on said second image transfer surface.

10. The apparatus as claimed in claim 1, further comprising:

third image transferring means for transferring the composite image from said second image transfer body to a third image transfer body driven by a third drive means to move through a third image transfer position where said third image transfer body is adjacent to said second image transfer body;

means for making a speed at which the first image transfer surface of said first image transfer body moves equal to a speed at which a third image transfer surface of said third image transfer body moves; and means for making a period of time necessary for the second image transfer surface of said second image transfer body to move from the second image transfer position to the third image transfer position in the direction of movement of said second image transfer body a natural number multiple of a period of speed variation occurring on said second image transfer surface of said second image transfer body.

11. The apparatus as claimed in claim 10, wherein the second image transfer surface of said second image transfer body is endless, a same position of said second image transfer surface of said second image transfer body is moved by the second moving means through the second image transfer position a plurality of times, whereby the composite image is transferred from said first image transfer surface of said first image transfer body to said second image transfer surface of said second image transfer body one above another, and means for making a period of time necessary for the second image transfer surface of said second image transfer body to move from the third image transfer position to the second image transfer position in the direction of movement of said second image transfer body is a natural number multiple of the period of speed variation occurring on said second image transfer surface.

12. An image forming apparatus comprising:

a single or a plurality of image carriers;

image forming means for forming a plurality of different images on said single or said plurality of image carriers;

first image transferring means for transferring the images from said single or said plurality of image carriers to a first transfer body driven by a first drive means to move through a first image transfer position corresponding to said single image carrier and located where said first transfer body is adjacent to said single image carrier or through plural first image transfer positions corresponding to said plurality of image carriers where said first image transfer body is adjacent to said plurality of image carriers;

second image transferring means for transferring the images from said first image transfer body to a second image transfer body driven by a second drive means to move through a second image transfer position where said second image transfer body is adjacent to said first image transfer body; and means for driving said single or said plurality of image carriers, wherein, when said plurality of image carriers are present, said means for driving drives said plurality of image carriers such that mean moving speeds of image carrying surfaces of said plurality of image carriers are equal to each other;

wherein a nip width for image transfer between each image carrier present and said first image transfer body at the first image transfer position or the plurality of first image transfer positions does not vary, said image forming means exposes the image carrying surface of said single image carrier or the image carrying surfaces of said plurality of image carriers in accordance with image data to thereby form latent images and then develops said latent images for thereby producing corresponding toner images, and means for selecting an exposing timing or an exposing position assigned to the image carrying surface of each image carrier present in accordance with at least either one of eccentricity and irregularity in radius of said each image carrier present and, when said plurality of image carriers are present, a distance between said plurality of image carriers.

13. The apparatus as claimed in claim 12, wherein a first image transfer surface of said first image transfer body is flexible or elastic.

14. The apparatus as claimed in claim 13, further comprising pressing means for pressing said first image transfer surface of said first image transfer body against each image carrier present at the first image transfer position corresponding to said single image carrier or at the plurality of first image transfer positions corresponding to said plurality of image carriers.

15. An image forming apparatus comprising:

single or each of said plurality of image carriers;

means for rotating said single or said plurality of image carriers;

image forming means for forming a plurality of images on said single or said plurality of rotating image carriers;

first image transferring means for transferring the images from said single or said plurality of rotating image carriers to a first image transfer body driven by a first drive means so as to move through a first image transfer position corresponding to said single image carrier and located where said first transfer body is adjacent to said single image carrier through plural first image transfer positions corresponding to said plurality of image carriers where said first image transfer body is adjacent to said plurality of image carriers;

second image transferring means for transferring the images from said first image transfer body to a second image transfer body driven by a second drive means to move through a second image transfer position where said second image transfer body is adjacent to said first image transfer body; and means for making a speed Vd at which an image carrying surface of said single or each of said plurality of said plurality of rotating image carriers moves equal to a moving speed of a second image transfer surface of said second image transfer body, wherein a ratio $W_1/W_2$ of a nip width $W_1$ for image transfer between said image carrying surface of said single or each of said plurality of rotating image carriers and said first image transfer body at the first image transfer position or the plural first image transfer positions to a nip width $W_2$ for image transfer between said first image transfer body and said second image transfer body at the second image transfer position is equal to a ratio Vd/Vb of the moving speed Vd of the image carrying surface of said single or each of said plurality of rotating image carriers to a moving speed Vb of a first image transfer surface of said first image transfer body.

16. The apparatus as claimed in claim 15, further comprising:

means for making a period of time necessary for the first image transfer surface of said first image transfer body to move from the first image transfer position or the plural first image transfer positions to the second image transfer position in a direction of movement of said first image transfer body a natural number multiple of a period of speed variation occurring on said first image transfer surface.

17. The apparatus as claimed in claim 16, wherein the first image transfer surface of said first image transfer body is endless, and a same position of said first image transfer surface is moved by the first drive means to the first image transfer position a plurality of times when said single image carrier is present or the same position of said first image transfer surface is moved by the first drive means to be adjacent to different ones of said plurality of image carriers at the plural first transfer positions when said plurality of image carriers are present, whereby the images are transferred from said single or said plurality of rotating image carriers to said same position of said first image transfer surface of the first image transfer body one above another to form a composite image, said apparatus further comprising:

means for making a period of time necessary for the first image transfer surface of said first image transfer body to move from the second image transfer position to the first image transfer position when said single image carrier is present or to the plural first transfer positions when said plurality of image carriers are present in the direction of movement of said first image transfer body by said first drive means a natural number multiple of the period of speed variation occurring on said first image transfer surface.

18. The apparatus as claimed in claim 15, further comprising:

means for controlling said means for rotating said single or said plurality of image carriers so that, when said plurality of image carriers are present, said means for controlling controls said means for rotating such that mean moving speeds of image carrying surfaces of said plurality image carriers are equal to each other;

wherein said nip width $W_1$ does not vary, said image forming means exposes the image carrying surfaces of said single or said plurality of rotating image carriers in accordance with image data to thereby form latent images by selecting an exposing timing or an exposing position assigned to the image carrying surface of each image carrier present in accordance with at least either one of eccentricity and irregularity in radius of said each image carrier present and a distance between said image carriers when said plurality of image carriers are present and then develops said latent images for thereby producing corresponding toner images.

19. The apparatus as claimed in claim 18, wherein a first image transfer surface of said first image transfer body is flexible or elastic.

20. The apparatus as claimed in claim 19, further comprising pressing means for pressing said first image transfer surface of said first image transfer body against said each image carrier present at each corresponding first image transfer position.

21. The apparatus as claimed in claim 15, wherein said first image transfer body and said second image transfer body each comprise a roller, and an angular velocity of at least one of said single or said plurality of rotating image carriers, said first image transfer body roller, and said second image transfer body roller is selected in accordance with an irregularity in radius thereof.

22. The apparatus as claimed in claim 15, further comprising:

third image transferring means for transferring the composite image from said second image transfer body to a recording medium driven by a third drive means to move through a third image transfer position where said recording medium is adjacent to said second image transfer body; and wherein means for making a speed Vb1 at which a first image transfer surface of said first image transfer body moves equal to a speed at which a third image transfer surface of said recording medium moves, wherein a ratio $W_2/W_3$ of a nip width $W_2$ for image transfer between said first image transfer body and said second image transfer body at the second image transfer position to a nip width $W_3$ for image transfer between said second image transfer body and the recording medium at the third image transfer position is equal to a ratio Vb1/Vb2 of the moving speed Vb1 of the flat image transfer surface of said first image transfer body to a moving speed Vb2 of the second image transfer surface of said second image transfer body.

23. The apparatus as claimed in claim 22, further comprising:

means for making a period of time necessary for the first image transfer surface of said first image transfer body to move from the first image transfer position or the plural first image transfer positions to the second image transfer position in a direction of movement of said first image transfer body a natural number multiple of the period of speed variation occurring on said first image transfer surface.

24. The apparatus as claimed in claim 15, further comprising:

third image transferring means for transferring the images from said second image transfer body to a recording medium driven by a third drive means to move through a third image transfer position where said recording medium is adjacent to said second image transfer body;

wherein a difference between a moving speed Vb1 of the first image transfer surface of said first image transfer body and a moving speed vb2 of the second image transfer surface of said second image transfer body is ΔVh (=Vb1−Vb2), and influence coefficients $K_2$ and $K_3$ each are defined as a ratio of a dimension of a pixel, which expands or contracts due to an influence of image transfer process conditions other than nip widths and a difference in surface moving speed at each of the second image transfer position and said third image transfer position, to a dimension of said pixel free from said influence, a difference δ (=Vb1−$V_3$) between the moving speed Vb1 and a moving speed $V_3$ of a third image transfer surface of the recording medium satisfies a relation of $$\delta=(1-K_2/K_3)\cdot\Delta Vh.$$

25. The apparatus as claimed in claim 24, further comprising:

means for making a period of time necessary for the first image transfer surface of said first image transfer body to move from the first image transfer position or the plural first image transfer positions to the second image transfer position in a direction of movement of said first image transfer body a natural number multiple of a period of speed variation occurring on said first image transfer surface.

26. An image forming apparatus comprising:

a single or a plurality of rotatable image carriers;

means for rotating said single or said plurality of image carriers;

image forming means for forming a plurality of images on said single or said plurality of rotating image carriers;

first image transferring means for transferring the images from said single or said plurality of rotating image carriers to a first transfer body being driven by a first drive means so as to move through a first image transfer position corresponding to said single image carrier and located where said first transfer body is adjacent to said single image carrier or through plural first image transfer positions corresponding to said plurality of image carriers where said first image transfer body is adjacent to said plurality of image carriers;

second image transferring means for transferring the images from said first image transfer body to a second image transfer body driven by a second drive means to move through a second image transfer position where said second image transfer body is adjacent to said first image transfer body;

wherein a difference between a moving speed Vd of an image carrying surface of each image carrier present and a moving sped Vb of a first image transfer surface of said first image transfer body is ΔVh (=Vd−Vb), and influence coefficients $K_1$ and $K_2$ each are defined as a ratio of a dimension of a pixel, which expands or contracts due to an influence of image transfer process conditions other than nip widths and a difference in surface moving speed at the first image transfer position or plural first image transfer positions and at the second image transfer position, to a dimension of said pixel free from said influence, a difference $\delta(=Vd-V_2)$ between the moving speed Vd and a moving speed $V_2$ of a second image transfer surface of the said second image transfer body satisfies a relation of $$\delta=(1-K_1/K_2)\cdot\Delta Vh.$$

27. The apparatus as claimed in claim 26, wherein a ratio $W_1/W_2$ of a nip width $W_1$ for image transfer between each image carrier present and said first image transfer body at the first image transfer position or plural first image transfer positions to a nip width $W_2$ for image transfer between said first image transfer body and said second image transfer body at the second image transfer position is equal to a ratio Vd/Vb of a moving speed Vd of the image carrying surface of said each image carrier present to a moving speed Vb of the first image transfer surface of said first image transfer body.

28. The apparatus as claimed in claim 26, further comprising:

means for making a moving speed of the image carrying surface of said each image carrier present is equal to a moving speed of the second image transfer surface of said second image transfer body, and means for making a period of time necessary for the first image transfer surface of said first image transfer body to move from the first image transfer position or the plural first image transfer positions to the second image transfer position in a direction of movement of said first image transfer body is a natural number multiple of a period of speed variation occurring on said first image transfer surface.

29. The apparatus as claimed in claim 28, wherein the first image transfer surface of said first image transfer body is endless, and a same position of said first image transfer surface is moved by the first drive means to the first image transfer position a plurality of times when said single image carrier is present or the same position of said first image transfer surface is moved by the first drive means to face different ones of said plurality of image carriers at the plural first transfer positions when said plurality of image carriers are present, whereby the images are transferred from said single or said plurality of rotating image carriers to said same position of said first image transfer surface of the first image transfer body one above another to form a composite image, said apparatus further comprising:

means for making a period of time necessary for the first image transfer surface of said first image transfer body to move from the second image transfer position to the first image transfer position when said single image carrier is present or to the plural first transfer positions when said plurality of image carriers are present in the direction of movement of said first image transfer body by said first drive means a natural number multiple of the period of speed variation occurring on said image transfer surface.

30. The apparatus as claimed in claim 26, further comprising:

means for controllably driving said single or said plurality of image carriers, wherein, when said plurality of image carriers are present, said means for controllably driving drives said plurality of image carriers such that mean moving speeds of image carrying surfaces of said plurality of image carriers are equal to each other;

wherein nip width for image transfer between said each image carrier present and said first image transfer body at the first image transfer position or at the plural first transfer positions does not vary, said image forming means exposes the image carrying surfaces of said single or said plurality of rotating image carriers in accordance with image data to thereby form latent images by selecting an exposing timing or an exposing position assigned to the image carrying surface of said each image carrier present in accordance with at least either one of eccentricity and irregularity in radius of said each image carrier present and a distance between said image carriers when said plurality of rotating image carriers are present and then develops said latent images for thereby producing corresponding toner images.

31. The apparatus as claimed in claim 30, wherein the first image transfer surface of said first image transfer body is flexible or elastic.

32. The apparatus as claimed in claim 31, further comprising pressing means for pressing the first image transfer surface of said first image transfer body against said each image carrier present at each corresponding first image transfer position.

33. The apparatus as claimed in claim 26, wherein said first image transfer body and said second image transfer body each comprise a roller, and an angular velocity of at least one of said single or said plurality of rotating image carriers, said first image transfer body roller, and said second image transfer body roller is selected in accordance with an irregularity in radius thereof.

34. The apparatus as claimed in claim 26, further comprising:

third image transferring means for transferring the images from said second image transfer body to a recording medium driven by a third drive means to move through a third image transfer position where said recording medium is adjacent to said second image transfer body; and means for making a speed at which a first image transfer surface of said first image transfer body moves is equal to a moving speed of a third image transfer surface of said recording medium, wherein a ratio $W_2/W_3$ of a nip width $W_2$ for image transfer between said first image transfer body and said second image transfer body at the second image transfer position to a nip width $W_3$ for image transfer between said second image transfer body and the recording medium at the third image transfer position is equal to a ratio Vb1/Vb2 of a moving speed Vb1 of the first image transfer surface of said first image transfer body to a moving speed Vb2 of the second image transfer surface of said second image transfer body.

35. The apparatus as claimed in claim 34, further comprising:

means for making a moving speed of the image carrying surface of said single or each of said plurality of rotating image carriers equal to a moving speed of the second image transfer surface of said second image transfer body, and means for making a period of time necessary for the first image transfer surface of said first image transfer body to move from the first image transfer position or the plural first image transfer positions to the second image transfer position in a direction of movement of said first image transfer body is a natural number multiple of a period of speed variation occurring on said first image transfer surface.

36. The apparatus as claimed in claim 26, further comprising:

third image transferring means for transferring the images from said second image transfer body to a recording medium driven by a third drive means to move through a third image transfer position where said recording medium is adjacent to said second image transfer body;

wherein a difference between a moving speed Vb1 of the first image transfer surface of said first image transfer body and a moving speed vb2 of the second image transfer surface of said second image transfer body is ΔVh (=Vb1−Vb2), and influence coefficients $K_2$ and $K_3$ each are defined as a ratio of a dimension of a pixel, which expands or contracts due to an influence of image transfer process conditions other than nip widths and a difference in surface moving speed at each of the second image transfer position and said third image transfer position, to a dimension of said pixel free from said influence, a difference δ(=Vb1−$V_3$) between the moving speed Vb1 and a moving speed $V_3$ of a third image transfer surface of the recording medium satisfies a relation of $$\delta(1-K_2/K_3)\cdot\Delta Vh.$$

37. The apparatus as claimed in claim 36, further comprising:

means for making a moving speed of the image carrying surface of said single or each of said plurality of rotating image carriers equal to a moving speed of the second image transfer surface of said second image transfer body, and means for making a period of time necessary for the first image transfer surface of said first image transfer body to move from the first image transfer position or the plural first image transfer positions to the second image transfer position in a direction of movement of said first image transfer body is a natural number multiple of a period of speed variation occurring on said first image transfer surface.

38. An image forming apparatus comprising:

a single or a plurality of image carriers;

means for rotating said single or said plurality of image carriers:

image forming means for forming a plurality of images on said single or said plurality of rotating image carriers;

difference δ(=Vb1−$V_3$) between the moving speed Vb1 and a moving speed $V_3$ of a third image transfer surface of the recording medium satisfies a relation of $$\delta=(1-K_2/K_3)\cdot\Delta Vh.$$

39. The apparatus as claimed in claim 38, further comprising:

means for making a speed at which an image transfer surface of said first image transfer body moves is equal to a moving speed of an image transfer surface of the recording medium, and a ratio $W_2/W_3$ of a nip with $W_2$ for image transfer between said first image transfer body and said second image transfer roller at the second image transfer position to a nip width $W_3$ for image transfer between said second image transfer body and the recording medium at the third image transfer position is equal to a ratio Vb1/Vb2 of a moving speed Vb1 of the first image transfer surface of said first image transfer body to a moving speed Vb2 of the second image transfer surface of said second image transfer roller.

40. The apparatus as claimed in claim 39, further comprising:

means for making a moving speed of the image carrying surface of each image carrier equal to a moving speed of the second image transfer surface of said second image transfer roller, and means for making a period of time necessary for the first image transfer surface of said first image transfer body to move from the first image transfer position to the second image transfer position in a direction of movement of said first image transfer body a natural number multiple of a period of speed variation occurring on said first image transfer surface.

41. The apparatus as claimed in claim 38, wherein that a difference between a moving speed Vb1 of the first image transfer surface of said first image transfer body and a moving speed vb2 of the second image transfer surface of said second image transfer body is ΔVh (=Vb1−Vb2), and influence coefficients $K_2$ and $K_3$ each are defined as a ratio of a dimension of a pixel, which expands or contracts due to an influence of image transfer process conditions other than nip widths and a difference in surface moving speed at each of the second image transfer position and said third image transfer position, to a dimension of said pixel free from said influence, a carrier and located where said first transfer body is adjacent to said single image carrier or through plural first image transfer positions corresponding to said plurality of image carriers where said first image transfer body is adjacent to said plurality of rotating image carriers;

second image transferring means for transferring the images from said first image transfer body to a second image transfer body driven by a second drive means to move through a second image transfer position where said second image transfer body is adjacent to said first image transfer body; and wherein means for making a moving speed of an image carrying surface of each image carrier present higher than a moving speed of a second image transfer surface of said second image transfer body.

42. The apparatus as claimed in claim 41, further comprising:

means for making a moving speed of the image carrying surface of each image carrier equal to a moving speed of the second image transfer surface of said second image transfer roller, and means for making a period of time necessary for the first image transfer surface of said first image transfer body to move from the first image transfer position to the second image transfer position in a direction of movement of said first image transfer body a natural number multiple of a period of speed variation occurring on said first image transfer surface.

* * * * *